US008582988B2

(12) United States Patent
Rapkin et al.

(10) Patent No.: US 8,582,988 B2
(45) Date of Patent: Nov. 12, 2013

(54) EFFECTIVELY USING A CONSUMABLE IN TWO PRINTERS

(75) Inventors: Alan E. Rapkin, Pittsford, NY (US); Walter B. Sherwood, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 549 days.

(21) Appl. No.: 12/890,946

(22) Filed: Sep. 27, 2010

(65) Prior Publication Data

US 2012/0076517 A1 Mar. 29, 2012

(51) Int. Cl.
*G03G 15/00* (2006.01)

(52) U.S. Cl.
USPC ..... 399/24

(58) Field of Classification Search
USPC ..... 399/24–27
See application file for complete search history.

(56) References Cited

U.S. PATENT DOCUMENTS

| | | | |
|---|---|---|---|
| 5,608,643 | A | 3/1997 | Wichter et al. |
| 5,924,076 | A | 7/1999 | Carr et al. |
| 6,370,340 | B1 | 4/2002 | Regelsberger |
| 6,608,641 | B1 | 8/2003 | Alexandrovich et al. |
| 6,980,887 | B2 | 12/2005 | Varga et al. |
| 7,120,379 | B2 | 10/2006 | Eck |
| 7,250,959 | B2 | 7/2007 | Cloutier et al. |
| 7,350,902 | B2 | 4/2008 | Dietl et al. |
| 7,440,880 | B2 | 10/2008 | Radulski |
| 7,479,976 | B2 | 1/2009 | Ehmann |
| 7,514,028 | B2 | 4/2009 | Kung et al. |
| 7,522,179 | B2 | 4/2009 | Lysiak et al. |
| 7,726,892 | B2 | 6/2010 | Lysiak et al. |
| 2002/0168200 | A1 | 11/2002 | Stelter et al. |
| 2006/0133870 | A1 | 6/2006 | Ng et al. |
| 2008/0201241 | A1 | 8/2008 | Pecoraro |

FOREIGN PATENT DOCUMENTS

| | | |
|---|---|---|
| EP | 1 560 081 | 1/2005 |

OTHER PUBLICATIONS

U.S. Appl. No. 12/642,883, filed Dec. 1, 2009, O'Learly et al.

*Primary Examiner* — Walter L Lindsay, Jr.
*Assistant Examiner* — Ruth Labombard
(74) *Attorney, Agent, or Firm* — Christopher J. White

(57) ABSTRACT

In a multi-printer system with two marking engines, the jobs printed are monitored and the remaining lives of consumables in replaceable units (RUs) in the engines are estimated. A decision unit responsive to the estimated lives of the consumables determines that the first RU in the first marking engine should be moved to the second marking engine at a selected service time, so that a remaining amount of the consumable in the first RU is not discarded.

3 Claims, 14 Drawing Sheets

EFFECTIVELY USING A CONSUMABLE IN TWO PRINTERS

CROSS-REFERENCE TO RELATED APPLICATIONS

Reference is made to commonly-assigned, co-pending U.S. patent application Ser. No. 12/890,899, filed concurrently herewith, entitled "Indicating Consumable Replenishment Time" by Alan E. Rapkin et al, U.S. patent application Ser. No. 12/890,992, filed concurrently herewith, entitled "Effectively Using Two Consumables In Single Printer" by Alan E. Rapkin et al, and U.S. patent application Ser. No. 12/890,873, filed concurrently herewith, entitled "Replenishing Consumable At Service Time In Printer" by Alan E. Rapkin, et al, the disclosures of which are incorporated herein.

FIELD OF THE INVENTION

This invention pertains to the field of printing and more particularly to management of consumables in a printer.

BACKGROUND OF THE INVENTION

Printing, the producing of hardcopy output to convey information or provide decoration, is a significant industry. Imprinting devices or printing systems such as electrophotographic, inkjet, and thermal printers deposit colorants onto receivers to produce print images. Other imprinting devices, such as facsimile (fax) machines and silver halide (AgX) printers, induce chemical changes in a receiver to cause it to develop a differential pattern of colorant on its surface, thereby providing the print image.

The colorants and receivers are examples of consumables. Consumables are stored in replaceable units (RUs, e.g., cartridges or bottles) and have a limited lifetime. When a consumable is depleted, i.e., no further supply of that consumable is available to the printer, jobs requiring that consumable can not be printed until the consumable is replenished, i.e., until more of the consumable is provided to the printer, typically by replacing the depleted RU with a full RU (new or refilled).

Providers of print services to consumers, e.g., photo developing shops, want to use as much of the consumable in each RU as possible, to save money on consumables, but do not want to run out of a consumable and therefore experience printer downtime during a period of high consumer demand.

In restaurants, partially-depleted ketchup bottles (RUs) can be combined to provide one full ketchup bottle that will satisfy a customer for the duration of his meal (avoiding running out during a demand period). However, this scheme is not generally applicable to printer consumables. Toner and ink are both difficult to handle and to clean. Inkjet RUs (ink cartridges) are highly sophisticated, and refilling one can result in the RU's becoming unable to supply any of the ink therein to the printer. Furthermore, attempting to combine consumables in two RUs can result in loss of material spilled on the floor. Furthermore, some RUs in printers are individual items with a fixed life (e.g., electrophotographic fuser rollers) and cannot be combined with others, even if partially depleted. Some consumables can be combined, such as media rolls that can be spliced together, but such operations are manual and error-prone. For example, hand-splicing of partially-depleted media rolls can increase receiver skew, result in contamination inside the printer when the splice passes through, and increase the risk of media jams in the printer (which can be time-consuming to clear, and can lead to damage in various printing systems).

Other problem domains that might seem analogous to consumable replenishment in a printer are vending machine loading, retail inventory management, and military logistics. However, these applications operate over much longer periods than printer consumable replenishments. For example, some inkjet printer cartridges can print only approximately 50 4"×6" photographs, or approximately two rolls of film, before being depleted. In a retail photo printing environment, this would result in depletion many times per day, rather than depletion once per several days as could be the case in the problem domains listed above. This difference in time scale changes the problem qualitatively, not just quantitatively. For example, vending machines require a service technician to drive to a machine, so multiple vending machines are restocked on the same trip whenever possible. This constraint generally does not apply to the replenishing of consumables in printers.

Furthermore, restocking in a retail store does not cause downtime, unlike in a printer. Retail stores also often maintain available inventory in the back, off the shelves, from which it is readily available. The back-of-store inventory serves as a buffer to reduce the risk of depletion and unsatisfied customers; printers generally do not have such mechanisms.

Regarding vending machines, U.S. Publication No. 2008/0201241 describes an automated coffee dispenser that dynamically calculates inventory levels based on drinks served. Ingredient restocking data (dates, quantities) are loaded into the system. The system can automatically switch from empty ingredients containers to full ones. However, most printers can only hold the RUs they are actively using, and require the attention of an operator to change to a new RU when an old RU is depleted.

U.S. Pat. No. 6,980,887 describes a self-monitoring vending machine with remote network communication to provide efficient scheduling of service calls. A remote processing center calculates the capacity and velocity of the goods in the machine based on the amount dispensed. A preferred configuration of types of goods is determined to improve time efficiency between service periods for restocking of different types of goods. However, this scheme is only applicable where there is a choice of goods in the machine. Imprinting devices have consumables that are required for every job, to which different configurations are not applicable.

U.S. Pat. No. 5,608,643 describes a vending machine with a reference level sensor to determine when inventory of a product drops below a reference level that is higher than an out of stock level of the associated bin. Many printers have similar sensors to monitor their consumables. However, the scheme of '643 applies to vending machines, which operate on very different time scales than printers, as discussed above. The scheme of '643 uses the sales on past days to estimate sales on future days. This estimation cannot predict changes in sales due to special events or seasonal changes.

Commonly-assigned U.S. Pat. No. 6,370,340 describes tracking the usage of a printer using low-frequency and high-frequency sampling. This facilitates troubleshooting of the printer. Although useful, this patent does not provide consumable-replenishment schedules.

U.S. Pat. No. 7,444,088 describes a printing system with several marking engines. Print jobs are assigned to specific marking engines to balance the usage of a consumable by all the marking engines. However, this scheme does not provide any way of avoiding depletion at an undesirable time. Indeed it permits depletion to occur at the same time on multiple printers, increasing the likelihood that one marking engine will be unable to serve as a backup for another.

These schemes describe various ways of load-balancing and replenishing or restocking, but do not take into account the time scale of printer operation and the constraints on consumables in printers. There is a continuing need, therefore, for a way of managing consumables in a printer, to use as much of the consumable in each RU as possible without running out of a consumable during a period of high consumer demand.

SUMMARY OF THE INVENTION

According to the present invention, there is provided a multi-printer system for indicating a replaceable unit should be moved from one marking engine to another so that a consumable in the replaceable unit is not discarded, comprising:

a. a front end for providing a plurality of print jobs to be printed, each having corresponding data;

b. a first marking engine, for using a first consumable stored in a first replaceable unit (RU) to print selected jobs at corresponding times on corresponding receivers;

c. a second marking engine, for using a second consumable stored in a second replaceable unit (RU) to print selected jobs at corresponding times on corresponding receivers, wherein the first and second replaceable units are interchangeable;

c. means for receiving a personnel schedule including a plurality of service times and personnel labor rates;

d. a monitoring system for recording the corresponding data and corresponding times for a plurality of the jobs on the first and second marking engines;

e. a life-estimating unit responsive to the received personnel schedule, the recorded corresponding data, and the recorded corresponding times, for estimating the remaining life of the first consumable in the first marking engine and remaining life of the second consumable in the second marking engine at a selected one of the service times;

f. a decision unit responsive to the estimated lives of the first and second consumables for determining that the first RU in the first marking engine should be moved to the second marking engine at the selected service times; and g. an interface responsive to the decision unit for indicating that the first RU should be moved from the first engine to the second engine at the selected service time, so that a remaining amount of the consumable in the first RU is not discarded.

An advantage of this invention is that it provides more complete use of the consumable in an RU without lost-revenue downtime. The invention can be used effectively in constrained situations requiring certain consumables. The invention can forecast end-of-life of a consumable, taking into account holidays, seasonal variation, and other causes of rapid shift in the demand for a consumable. The invention permits using multiple printers in a print shop with improved utilization of consumables in each printer.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
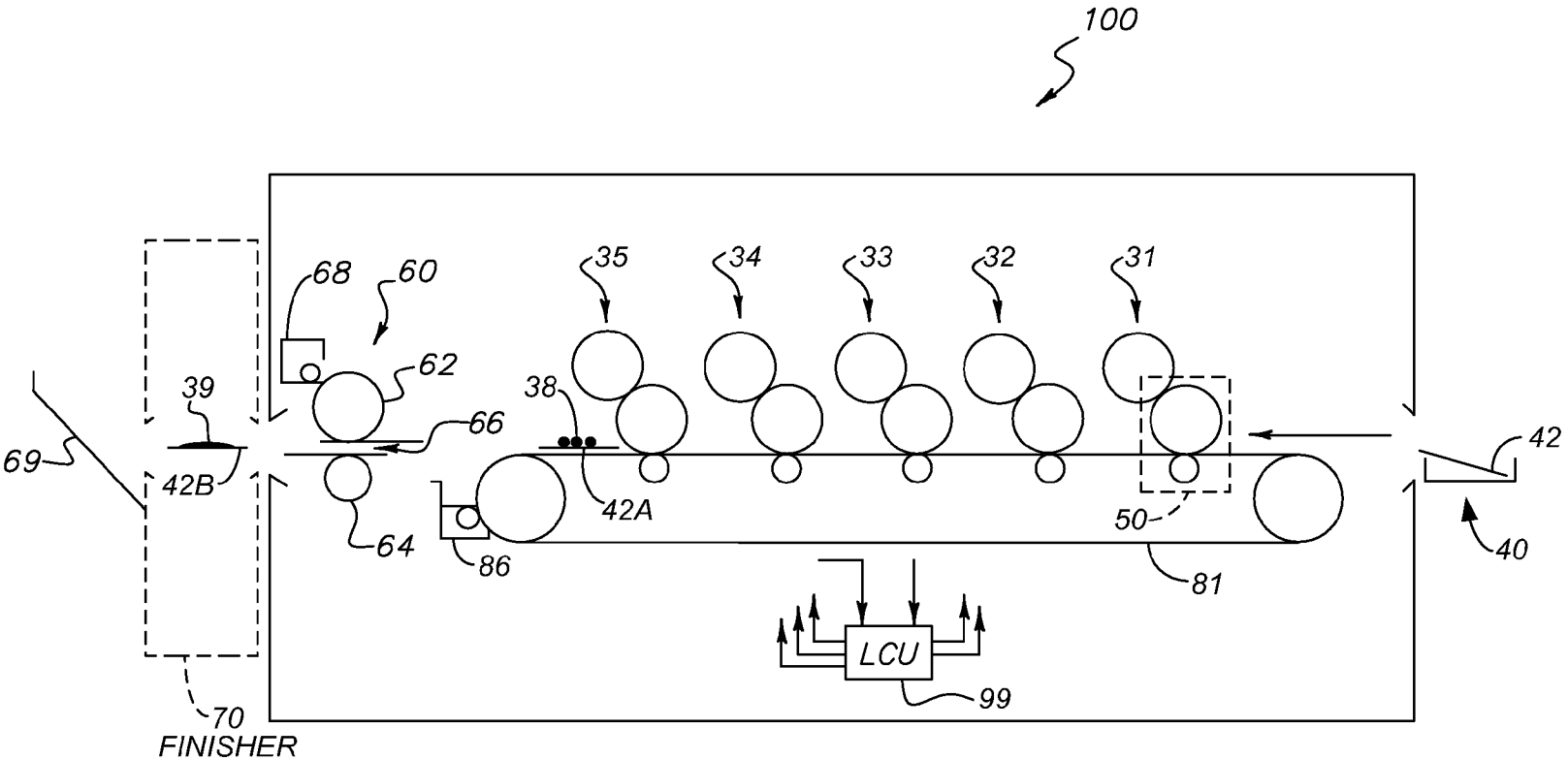
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, an "imprinting device," "printing system," or "printer" is a device for producing hardcopy output, i.e., for applying a desired pattern to a receiver, e.g., to convey information or provide decoration. "Printer" includes copiers, scanners, and facsimiles, and analog or digital devices. A printer includes a "marking engine" that applies material to the receiver or causes the pattern to be present in the receiver. A printer typically includes, in addition to a marking engine, a digital front-end processor (DFE) for receiving and preprocessing data indicating the pattern to be applied to the receiver. A printer can also include one or more post-printing finishing system(s) (e.g., a laminator system, a page trimmer, or a book-binding system).

A printer can reproduce pleasing black-and-white or color images onto a receiver. A printer can also produce selected patterns of a colorant or other material (e.g., electrophotographic toner) on a receiver, which patterns (e.g. surface textures) do not correspond directly to an image readily visible to the unaided human eye.

As used herein, the terms "parallel" and "perpendicular" have a tolerance of ±2°.

As used herein, "sheet" is a discrete piece of media, such as receiver media for an electrophotographic printer (described below). Sheets have a length and a width. Sheets can be folded along fold axes, e.g. positioned in the center of the sheet in the length dimension, and extending the full width of the sheet. A folded sheet contains two "leaves," each leaf being that portion of the sheet on one side of the fold axis. The two sides of each leaf are referred to as "pages." "Face" refers to one side of the sheet, whether before or after folding.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Section 1 of this description generally, not exclusively, describes various embodiments of marking engines. Section 2 of this description generally, not exclusively, describes various embodiments of printers that can use the marking engines of Section 1. The two sections are intended to be considered together, and embodiments from both sections are intended to be used in combination.

Section 1

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles, e.g. 15-20 μm or 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

The marking engine (also referred to in the art as a "print engine") in an EP printer applies toner to the receiver. An EP printer can include a DFE and one or more post-printing finishing system(s), e.g., a UV coating system, a glosser system, or a laminator system.

The DFE in any type of printer can receive input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
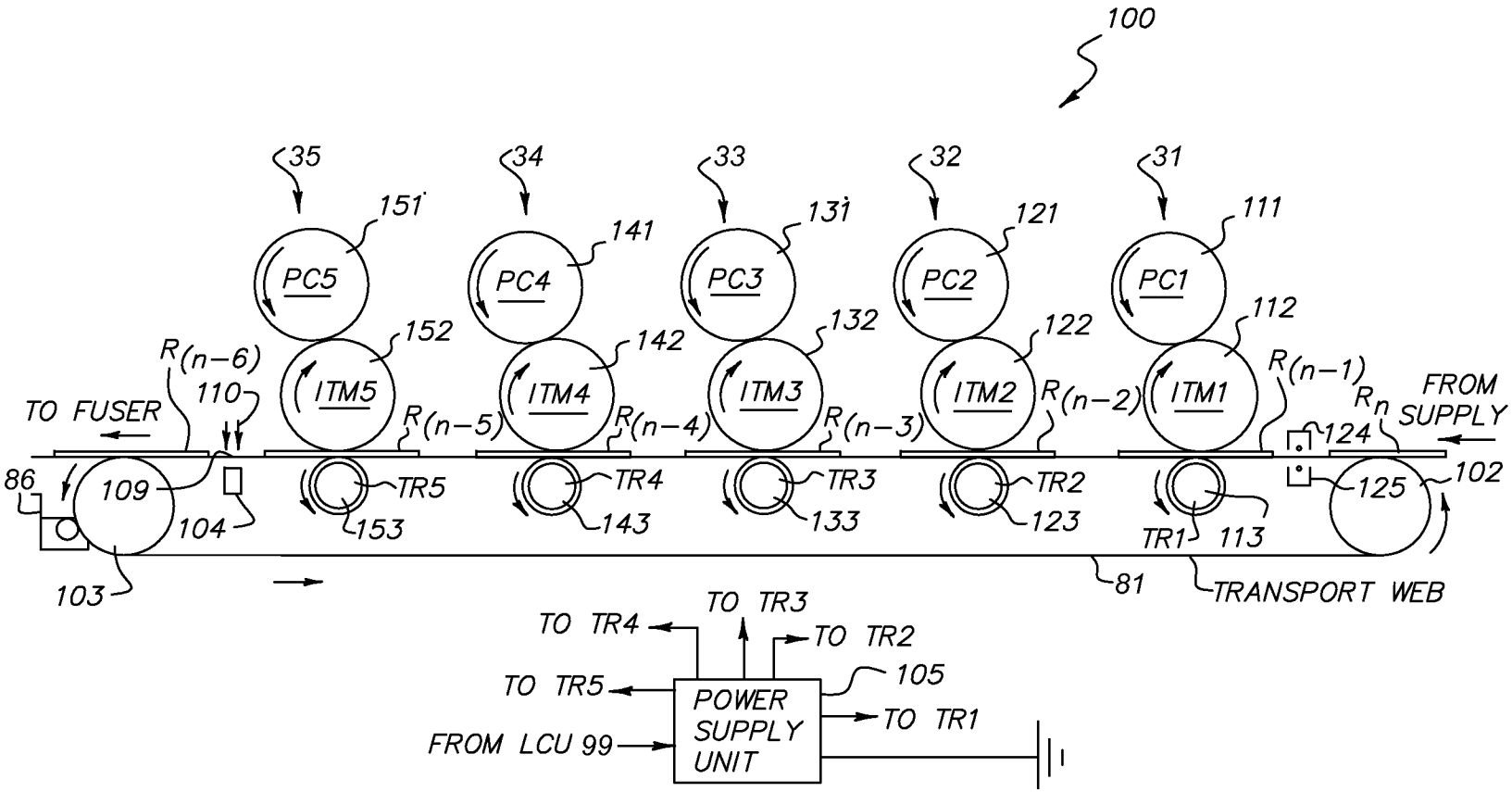
FIG. 2 is an elevational cross-section of the reprographic image-producing portion of the apparatus of FIG. 1.
Figure 3:
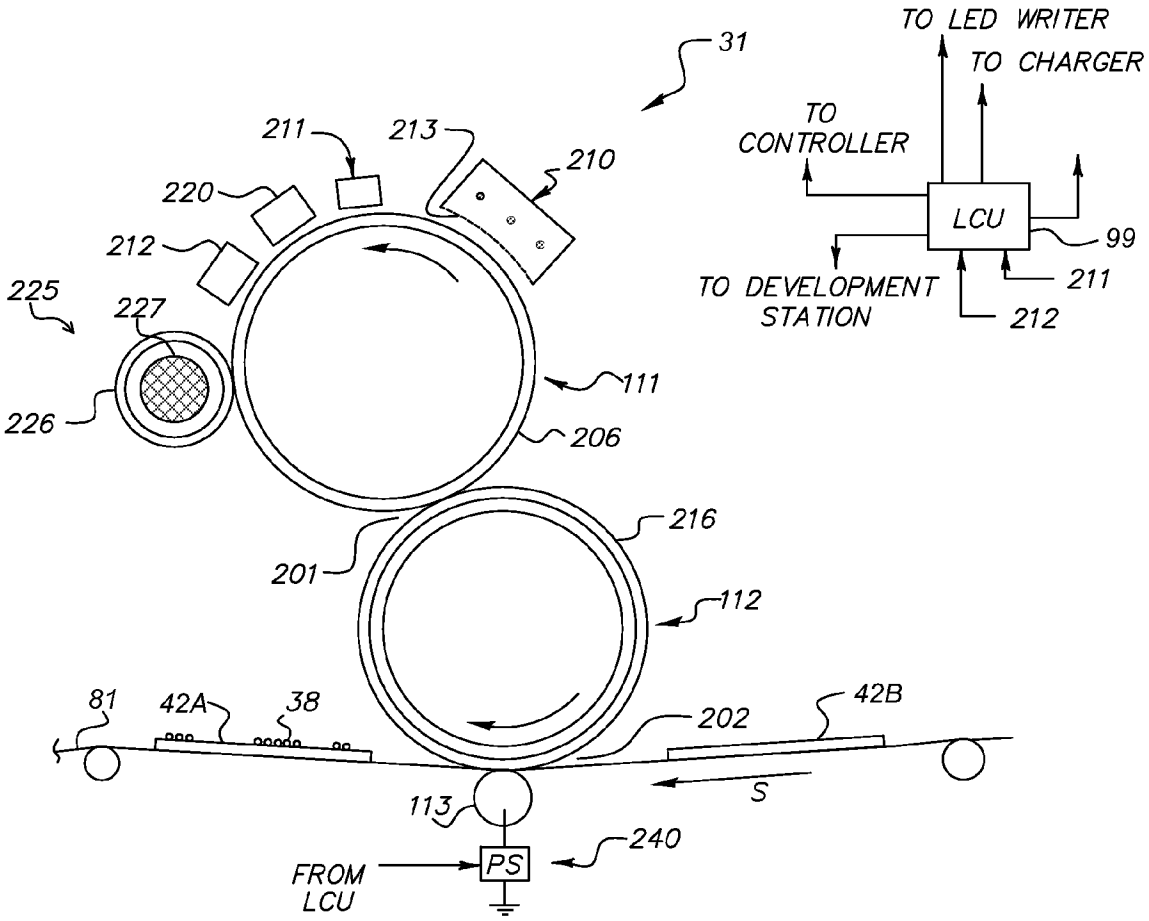
FIG. 3 is an elevational cross-section of one printing module of the apparatus of FIG. 1.

FIGS. 1-3 are elevational cross-sections showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member (111, 121, 131, 141, 151), e.g. a roller or belt, an intermediate transfer member (112, 122, 132, 142, 152), e.g. a blanket roller, and transfer backup member (113, 123, 133, 143, 153), e.g. a roller, belt or rod. Thus in printing module 31, a print image (e.g. a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40 (FIG. 1), is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Densitometer 104 is preferably located between printing module 35 and roller 103. Reflection densitometers, and more or fewer test patches, can also be used.

FIG. 3 shows more details of printing module 31, which is representative of printing modules 32, 33, 34, and 35. Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g. laser or LED writers), and the respective development station 225 of each printing module 31, 32, 33, 34, 35, among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g. of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 which the light source (e.g. laser or LED) can expose with a selected exposure different from the exposure of another engine pixel. Engine pixels can overlap, e.g. to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g. a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Steller et al., published Nov. 14, 2002, the disclosures of which are incorporated herein by reference. Development station 225 can also employ a mono-component developer comprising toner, either magnetic or non-magnetic, without separate magnetic carrier particles.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g. 42B) which receives the respective toned print images 38 from each printing module in superposition to form a composite image thereon. Print image 38 is e.g. a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Another type of printer useful with the present invention is a thermal printer. A thermal printer produces images on a receiver medium by transferring donor material from a donor ribbon to the receiver medium by selectively heating the donor ribbon while simultaneously pressuring the donor ribbon against the receiver medium. In this way, heated donor material transfers from the donor ribbon to the receiver medium to form an image while unheated donor material remains on the donor ribbon. Transfer may be by flow of melted donor material or by movement of sublimated donor material to the receiver medium. The donor ribbon and receiver medium are separated after transfer of the material to yield a receiver medium having a pattern of deposited donor material forming an image.

Donor ribbon is typically connected between a supply spool, which initially carries a supply of unused donor ribbon, and a take-up spool upon which used donor ribbon is wound. In operation, the take-up spool is rotated to draw donor ribbon from the supply spool and across the print head for use in printing. Often the donor spool and take-up spool are joined together by a structural framework to form a thermal donor cartridge. This structural framework positions the supply spool and the take-up spool in a preferred geometric relationship to facilitate proper loading and can also be used to provide surfaces that enclose or otherwise protect the donor ribbon from damage due to incidental contact and from damage due to exposure to contaminants. Such a thermal donor cartridge is disclosed in commonly-assigned U.S. Pat. No. 7,522,179 to Lysiak et al., issued Apr. 21, 2009. Various embodiments of a thermal cartridge useful with this invention are disclosed in U.S. Pat. No. 7,726,892 to Lysiak et al., issued Jun. 1, 2010.

An example of a thermal receiver useful with this invention is shown in U.S. Pat. No. 7,514,028 to Kung et al., issued Apr. 7, 2009. Examples of thermal printers useful with this invention are shown in U.S. Pat. No. 7,479,976 to Ehmann, issued Jan. 20, 2009, and in U.S. Pat. No. 7,250,959 to Cloutier et al., issued Jul. 31, 2007. The disclosures of the above-referenced '179, '892, '028, '976, and '959 patents are incorporated herein by reference.

Figure 11:
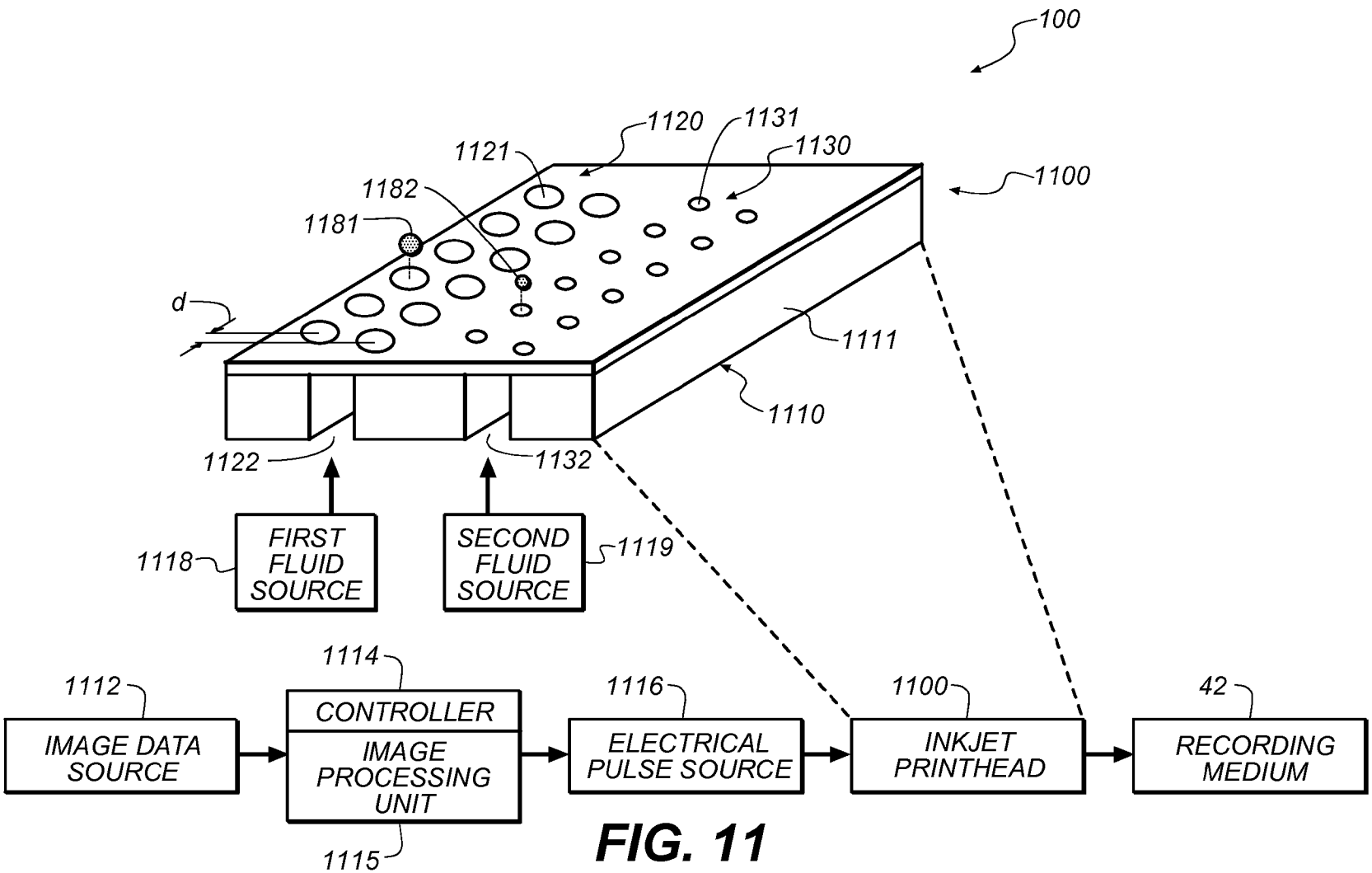
FIG. 11 is a schematic representation of an inkjet printer system.

Referring to FIG. 11, a schematic representation of an inkjet printer system 100 is shown. Inkjet printers are another type of printer useful with the present invention. Continuous or drop-on-demand printers can be used with the present invention. More details of inkjet printer 100 are presented in U.S. Pat. No. 7,350,902, and in co-pending U.S. patent application Ser. No. 12/642,883, the disclosures of which are incorporated by reference herein.

Inkjet printer system 100 includes an image data source 1112, which provides data signals that are interpreted by a controller 1114 as being commands to eject drops. Controller 1114 includes an image processing unit 1115 for rendering images for printing, and outputs signals to an electrical pulse source 1116 of electrical energy pulses that are inputted to an inkjet printhead 1100, which includes at least one inkjet printhead die 1110.

In the example shown in FIG. 11, there are two nozzle arrays. Nozzles 1121 in first nozzle array 1120 have larger opening areas than nozzles 1131 in second nozzle array 1130. In this example, each of the two nozzle arrays 1120, 1130 has two staggered rows of nozzles, each row having a nozzle density of 600 per inch. The effective nozzle density then in each array is 1200 per inch (i.e. spacing d=1/1200 inch in FIG. 11). If pixels on the receiver 42 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 1122 is in fluid communication with the first nozzle array 1120, and ink delivery pathway 1132 is in fluid communication with the second nozzle array 1130. Portions of ink delivery pathways 1122 and 1132 are shown in FIG. 11 as openings through printhead die substrate 1111. One or more inkjet printhead die 1110 will be included in inkjet printhead 1100, but for greater clarity only one inkjet printhead die 1110 is shown in FIG. 11. The printhead die are arranged on a support member as discussed below relative to FIG. 12. In FIG. 11, first fluid source 1118 supplies ink to first nozzle array 1120 via ink delivery pathway 1122, and second fluid source 1119 supplies ink to second nozzle array 1130 via ink delivery pathway 1132. Although distinct fluid sources 1118 and 1119 are shown, in some applications it may be beneficial to have a single fluid source supplying ink to both the first nozzle array 1120 and the second nozzle array 1130 via ink delivery pathways 1122 and 1132 respectively. Also, in some embodiments, fewer than two or more than two nozzle arrays can be included on printhead die 1110. In some embodiments, all nozzles on inkjet printhead die 1110 can be the same size, rather than having multiple sized nozzles on inkjet printhead die 1110.

Not shown in FIG. 11, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 1116 are sent to the various drop ejectors according to the desired deposition pattern. In the example of FIG. 11, droplets 1181 ejected from the first nozzle array 1120 are larger than droplets 1182 ejected from the second nozzle array 1130, due to the larger nozzle opening area. Typically other aspects of the drop forming mechanisms (not shown) associated respectively with nozzle arrays 1120 and 1130 are also sized differently in order to optimize the drop ejection process for the different sized drops. During operation, droplets of ink are deposited on a receiver 42.

Figure 12:
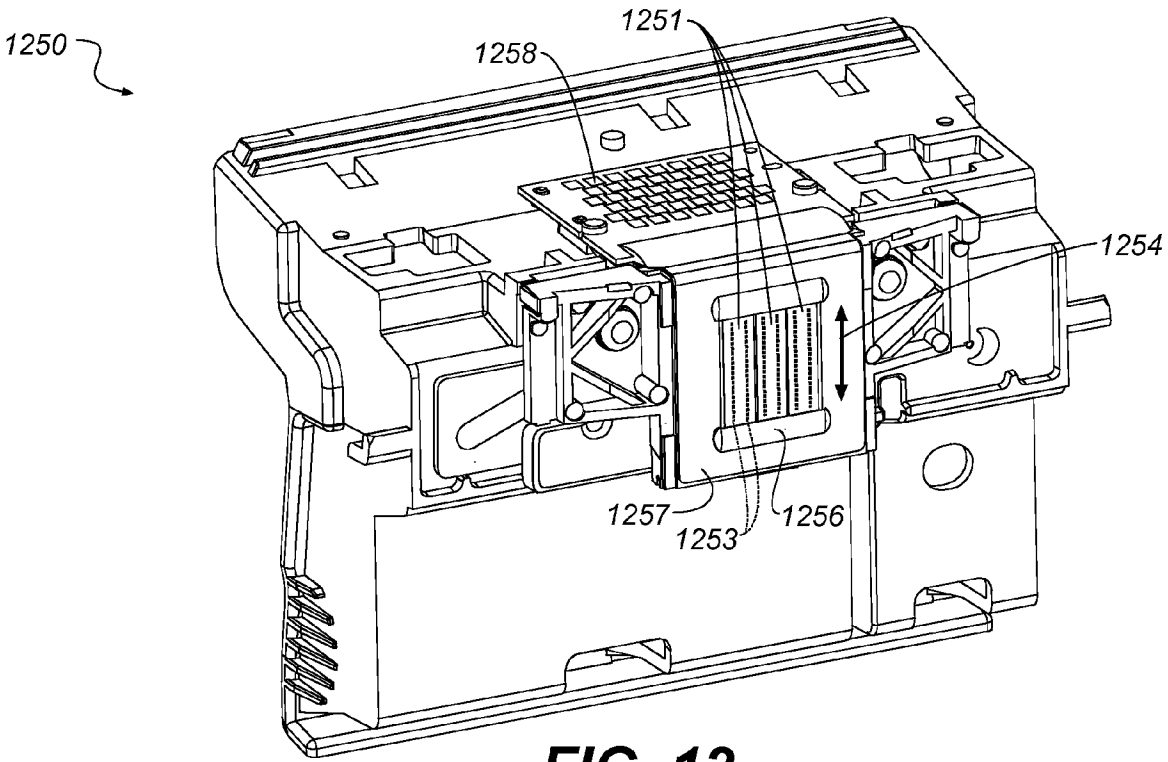
FIG. 12 is a perspective view of a portion of a printhead.

FIG. 12 shows a perspective view of a portion of a printhead 1250, which is an example of an inkjet printhead 1100. Printhead 1250 includes three printhead die 1251 (similar to printhead die 1110 in FIG. 11), each printhead die 1251 containing two nozzle arrays 1253, so that printhead 1250 contains six nozzle arrays 1253 altogether. The six nozzle arrays 1253 in this example can each be connected to separate ink sources (not shown in FIG. 12); such as cyan, magenta, yellow, text black, photo black, and a colorless protective printing fluid. Each of the six nozzle arrays 1253 is disposed along nozzle array direction 1254, and the length of each nozzle array along the nozzle array direction 1254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 1250 across the receiver 42. Following the printing of a swath, the receiver 42 is advanced along a media advance direction that is substantially parallel to nozzle array direction 1254.

Also shown in FIG. 12 is a flex circuit 1257 to which the printhead die 1251 are electrically interconnected, for example, by wire bonding or TAB bonding. The interconnections are covered by an encapsulant 1256 to protect them. Flex circuit 1257 bends around the side of printhead 1250 and connects to connector board 1258. When printhead 1250 is mounted into the carriage 1200 (see FIG. 13), connector board 1258 is electrically connected to a connector (not shown) on the carriage 1200 (FIG. 13), so that electrical signals can be transmitted to the printhead die 1251.

Figure 13:
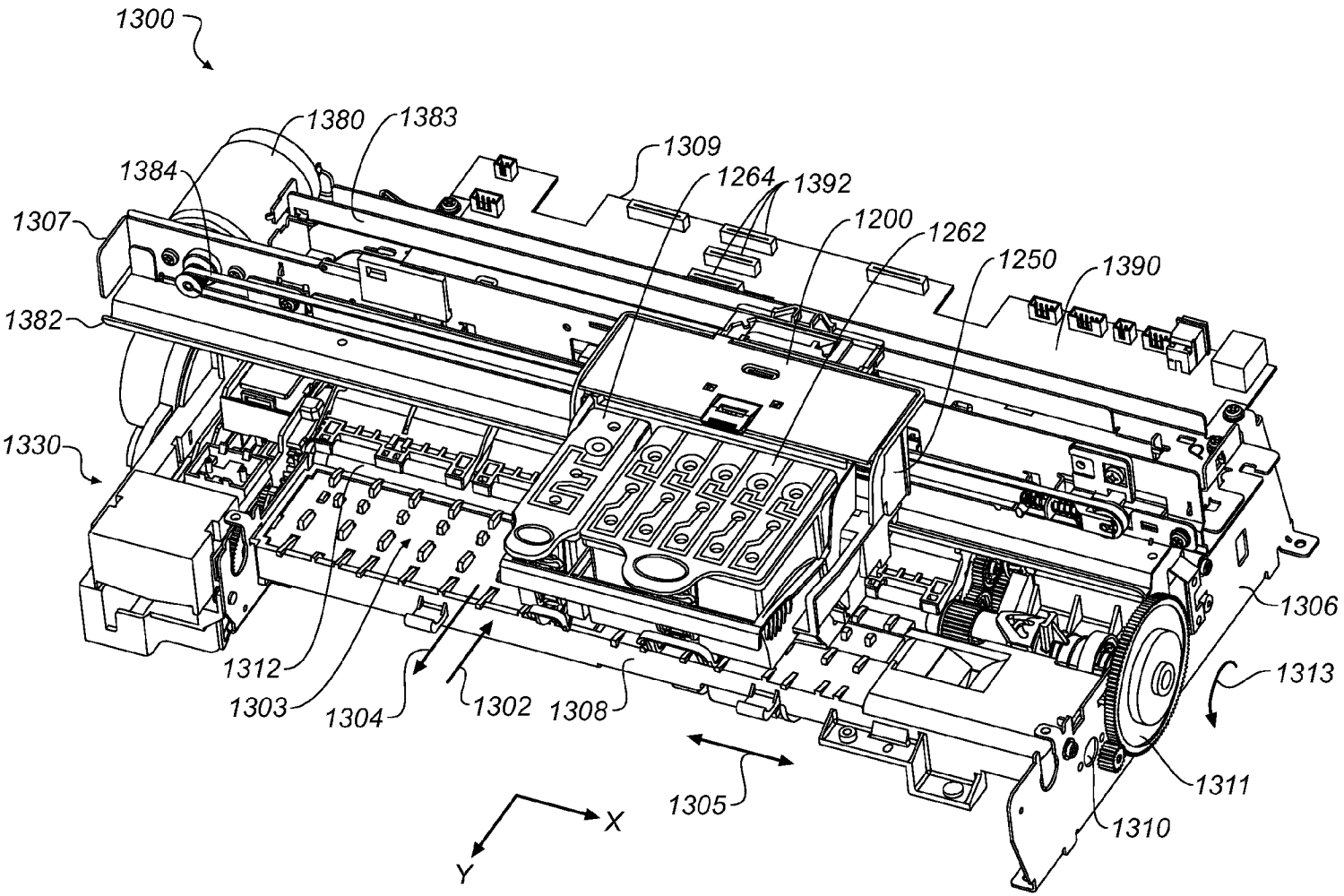
FIG. 13 is a perspective view of a portion of a carriage printer.

FIG. 13 shows a portion of a desktop carriage printer. Some of the parts of the printer have been hidden in the view shown in FIG. 13 so that other parts can be more clearly seen. Printer chassis 1300 has a print region 1303 across which carriage 1200 is moved back and forth in carriage scan direction 1305 along the X axis, between the right side 1306 and the left side 1307 of printer chassis 1300, while drops are ejected from printhead die 1251 (FIG. 12) on printhead 1250 that is mounted on carriage 1200. Carriage motor 1380 moves belt 1384 to move carriage 1200 along carriage guide rail 1382. An encoder sensor (not shown) is mounted on carriage 1200 and indicates carriage location relative to an encoder fence 1383.

Printhead 1250 is mounted in carriage 1200, and multi-chamber ink tank 1262 and single-chamber ink tank 1264 are installed in the printhead 1250. A printhead together with installed ink tanks is sometimes called a printhead assembly. The mounting orientation of printhead 1250 is rotated relative to the view in FIG. 12, so that the printhead die 1251 are located at the bottom side of printhead 1250, the droplets of ink being ejected downward onto the receiver in print region 1303 in the view of FIG. 13. Multi-chamber ink tank 1262, in this example, contains five ink sources: cyan, magenta, yellow, photo black, and colorless protective fluid; while single-chamber ink tank 1264 contains the ink source for text black. In other embodiments, rather than having a multi-chamber ink tank to hold several ink sources, all ink sources are held in individual single chamber ink tanks. Paper or other receiver (sometimes generically referred to as paper or media herein) is loaded along paper load entry direction 1302 toward the front 1308 of printer chassis 1300.

Figure 14:
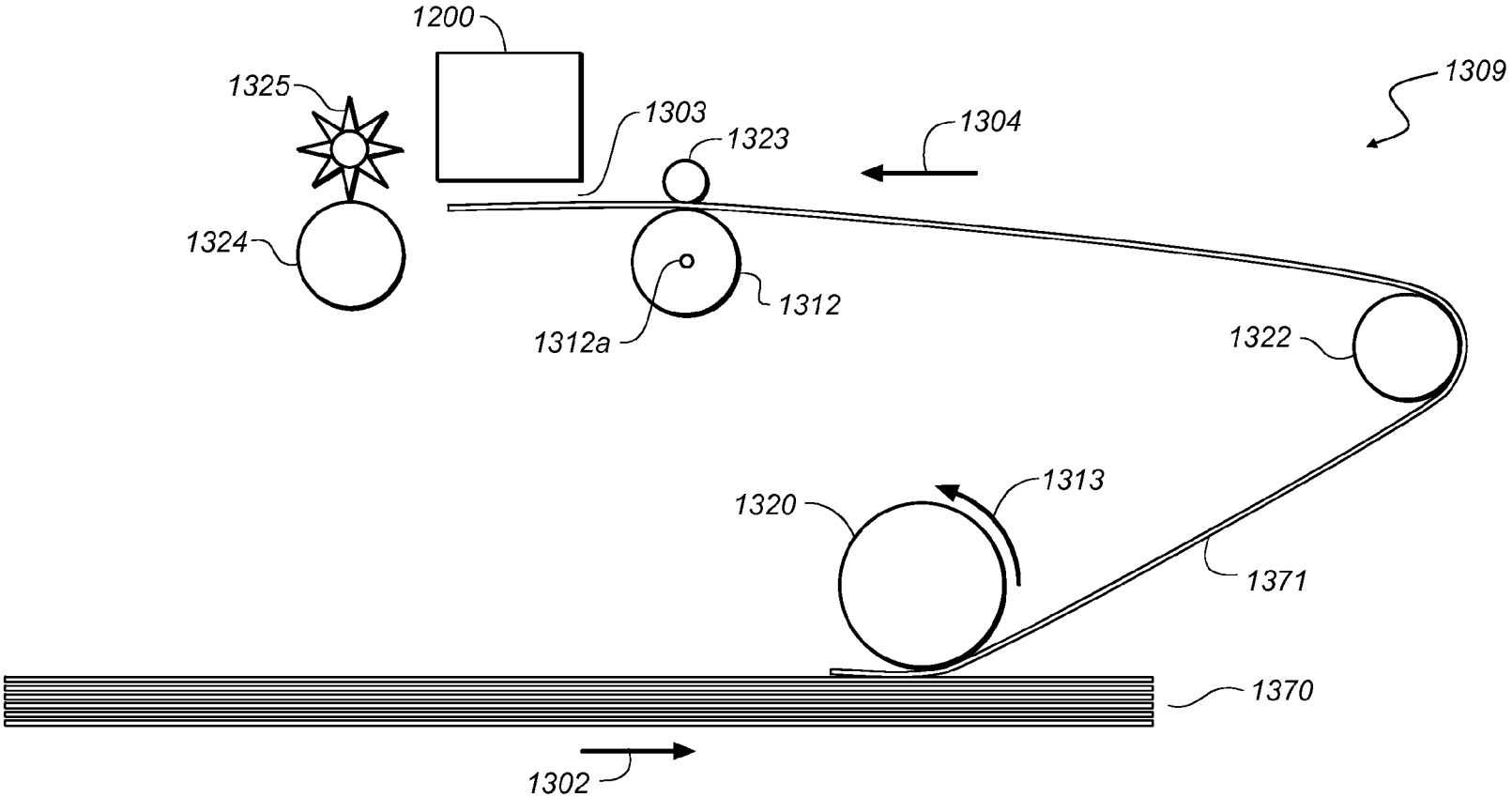
FIG. 14 is a schematic side view of an exemplary paper path in a carriage printer.

FIG. 14 schematically shows a side view of a variety of rollers used to advance the medium through the printer. Carriage 1200 is as discussed above with reference to FIG. 13. In this example, a pick-up roller 1320 moves the top piece or sheet 1371 of a stack 1370 of paper or other receiver in the direction of arrow, paper load entry direction 1302. A turn roller 1322 acts to move the paper around a C-shaped path (in cooperation with a curved rear wall surface) so that the paper continues to advance along media advance direction 1304 from the rear 1309 of printer chassis 1300 (FIG. 13). The paper is then moved by feed roller 1312 and idler roller(s) 1323 to advance along the Y axis across print region 1303, and from there to a discharge roller 1324 and star wheel(s) 1325 so that printed paper exits along media advance direction 1304 (FIG. 13). Feed roller 1312 includes feed roller shaft 1312*a* along its axis, and feed roller gear 1311 (FIG. 13) is mounted on feed roller shaft 1312*a*. Feed roller 1312 can include a separate roller mounted on feed roller shaft 1312*a*, or can include a thin high friction coating on feed roller shaft 1312*a*. A rotary encoder (not shown) can be coaxially mounted on feed roller shaft 1312*a* in order to monitor the angular rotation of feed roller 1312 (FIG. 13).

The motor that powers the paper advance rollers is not shown in FIG. 13, but the hole 1310 at the right side 1306 of printer chassis 1300 (FIG. 13) is where the motor gear (not shown) protrudes through in order to engage feed roller gear 1311, as well as the gear for the discharge roller (not shown). For normal paper pick-up and feeding, it is desired that all rollers rotate in forward rotation direction 1313. Toward the left side 1307 of the printer chassis 1300, in the example of FIG. 13, is the maintenance station 1330.

Toward the rear 1309 of printer chassis 1300, in this example, is located the electronics board 1390, which includes cable connectors 1392 for communicating via cables (not shown) to the printhead carriage 1200 and from there to the printhead 1250. Also on the electronics board are typically mounted motor controllers for the carriage motor 1380 and for the paper advance motor, a processor and/or other control electronics (shown schematically as controller 1114 and image processing unit 1115 in FIG. 11) for controlling the printing process, and an optional connector for a cable to a host computer.

Section 2

Figure 4:
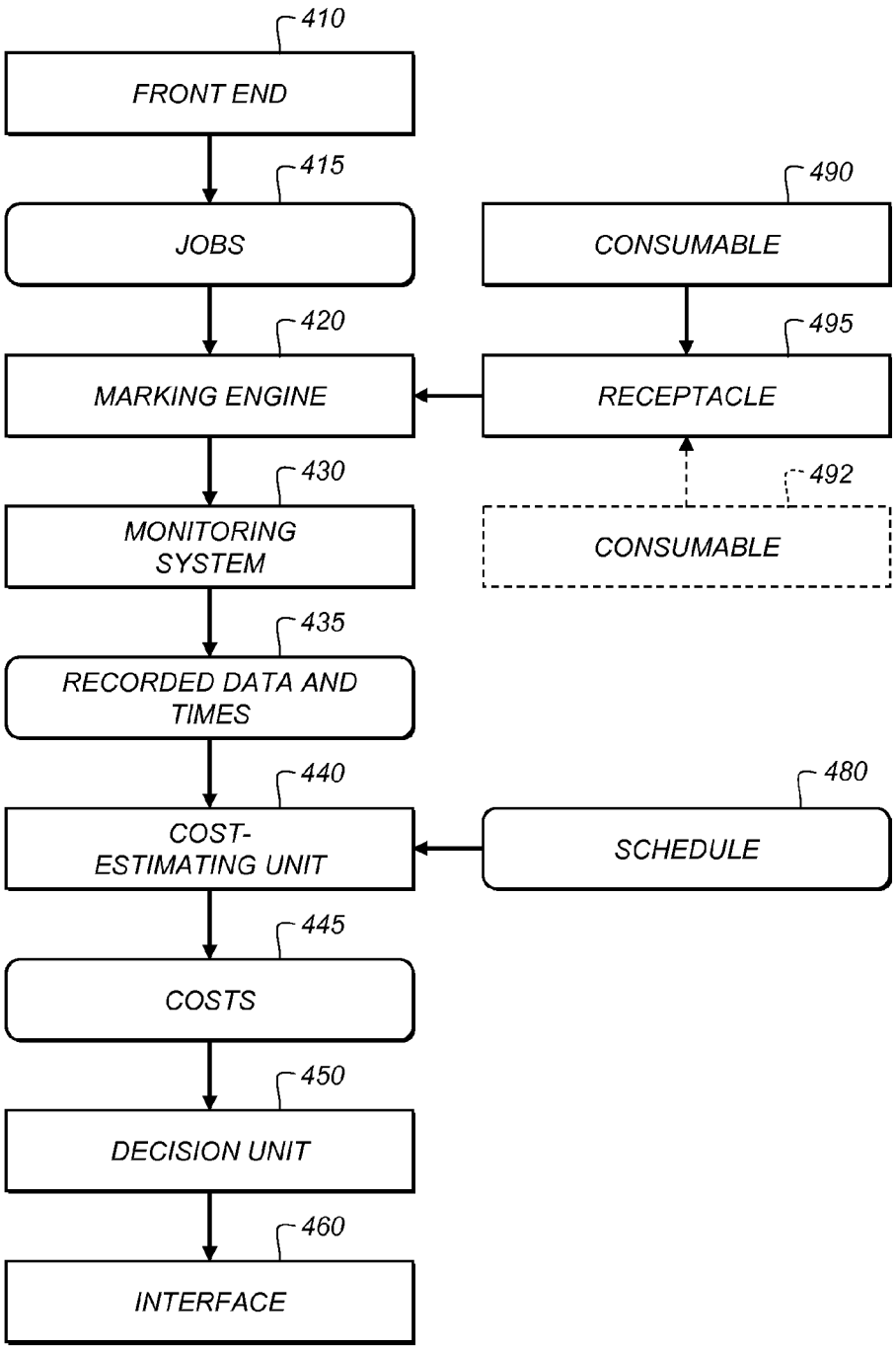
FIG. 4 is a schematic and dataflow diagram of a printing system for selecting a replacement unit to be installed at a service time according to an embodiment.

FIG. 4 is a schematic and dataflow diagram of a printing system for selecting a replacement unit to be installed at a service time according to an embodiment. Rectangles are components of the system and rounded rectangles are the data transmitted between the components. The printing system can be a printer, kiosk, wet or dry minilab, or other system for providing printed output on a receiver (such as glass, paper, metal, plastic, textiles, or another solid). The replacement unit has a consumable, which can be an imaging component, an equipment component, or another component replaceable independently of other components of the printing system.

Examples of consumables include toner, developer, paper, fusing rollers, fusing lamps, photoconductors, chargers, cleaners (e.g., brushes) and intermediate transfer belts. Examples of paper include bond, photo, and textured. As used herein, the waste-toner bins or other waste collection containers are also "consumables." Rather than needing to be filled periodically, such consumables need to be emptied periodically. (That is, the empty space in the waste container is consumed as waste is deposited, and that empty space needs to be replenished periodically.) Emptying waste containers can be performed without having to replace or fill other components of the printing system, so such a waste container is considered a consumable. In various embodiments, each consumable has a respective lifetime. The lifetime for some consumables, e.g., toner, depends on the type and content of jobs printed. As used herein, reference to a consumable's being "depleted" or at "end of life" means that the consumable is no longer capable of performing its intended function. For example, burned-out fuser lamps, empty toner bottles, and full waste bins are all depleted. In another example, a toner bottle is at end of life when the toner remaining in the bottle cannot be extracted and used to form print images on a receiver.

Consumables are stored in replaceable units (RUs). RUs are also known as customer-replaceable units (CRUs) or line-replaceable units (LRUs). These can be replaceable by the customer of the printer or by a service technician. For some consumables, e.g., a fuser roller assembly, the consumable is sufficiently strong to serve as its own RU. For other consumables, the consumable is mounted or contained within a rigid assembly that can be moved and positioned by hand. For yet other consumables, e.g., toner, the RU is a container such as a bag, tube, cartridge, canister, box, or other device for holding the consumable to adapt it for use in the printing system. For example, an RU for dry toner, which is a powder, can be a semi-rigid plastic canister with an opening on the bottom so that when the canister is inserted upright in a receptacle on a printer, toner feeds by gravity from the canister into the printer. As used herein, "replenishing a consumable" means "replacing the RU containing the consumable with an RU containing more of the consumable than the RU being replaced, or with an RU containing a consumable with longer life, than the consumable in the RU being replaced." "Replenishing a consumable" can include removing the existing RU, servicing it to increase the amount or life of consumable therein (e.g., emptying a waste bin, or refilling a toner bottle), and re-installing the existing RU in the printer. An RU can be depleted when no amount of the consumable remains in the RU, when the lifetime of the consumable in the RU has elapsed (as discussed above), or when an insufficient amount of the consumable remains in the RU to be usable. For example, some drop-on-demand inkjet cartridges are unable to extract all of the ink in a cartridge and deposit it on a receiver; the cartridge is depleted when no more ink can be extracted, even if ink remains in the cartridge.

Front end 410 of the printing system provides a plurality of print jobs 415 to be printed. Front end 410 can be a DFE, as described above. Front end 410 can be implemented using a computer, e.g., an IBM PC, a UNIX or LINUX server, or using an FPGA, PLD, PAL, DSP, or other special-purpose logic device.

Each job includes corresponding data. As used herein, the data of a print job is information that is recorded by monitoring system 430, discussed below. In various embodiments, the data of a print job is the full image data for the job, the RIPped data sent to the printer, the toner usage of the job in one or more colors, a single bit for each color indicating that color was used in the job, the percentage of each output page covered by toner, or the average of those percentages. Each print job can include other information that is used for printing, but is not recorded by monitoring system 430.

Receptacle 495 holds either a first consumable 490 stored in a first replaceable unit (RU), as described above, or a second consumable 492 stored in a second RU, but not both at the same time (for this reason, consumable 492 is shown dashed to indicate it is not simultaneously installed). The RUs are mechanically interchangeable and can contain the same or different consumables. For example, consumable 490 can be a black toner and consumable 492 can be a clear toner. The RUs for consumables 490, 492 can be identical or mechanically interchangeable in receptacle 495 on the printing system, so that either type of toner can be loaded. A printer can include multiple receptacles for holding multiple consumables; only one is shown here.

Electrophotographic marking engine 420 uses the consumable in receptacle 495 to print selected jobs. Marking engine 420 does not necessarily print all the jobs 415, since some jobs can be cancelled, paper can jam, the printer can fail, and for other reasons a job can be skipped. Each job that is printed is printed at a corresponding time on at least one corresponding receiver. A print job can extend across multiple receivers (e.g., a multi-page document). The corresponding time can be the time the job (in jobs 415) is received from front end 410, the time printing starts, the time printing is complete, an average of any two or more of those times, or another time representative of when the job was printed. The time can be stored in local time, UTC, or another timekeeping system. Either the same timekeeping system is used for each of a plurality of jobs printed, or the various timekeeping systems used are convertible between and among each other.

In printing systems with multiple receptacles holding different consumables, some consumables can be required for every job, and other consumables can be required for only a subset of the jobs. For example, clear toner can be optional for black text document jobs but required for photo jobs. Paper, however, can be required for all jobs. Moreover, depending on user requirements, the same content can be printed in different ways, e.g., with or without clear toner used to provide a glossy overcoat. Each job specifies the corresponding consumables required.

Monitoring system 430 records the corresponding data and corresponding times for a plurality of the jobs. The data and times can be recorded for some or all of the jobs printed.

The printing system receives a schedule 480 including a plurality of service times. Each service time is a time when it is preferred to repair the printing system, replenish consumables, or perform other maintenance. As used herein, "service time" does not refer to unscheduled maintenance due to operational failure of the printing system, paper jamming, unexpected consumable depletion, or other unscheduled failures. For example, in a retail-printing environment, service times can include the beginning and end of each shift, and times just before the store opens and just after it closes. At these times, customer disruption due to maintenance is lower than during peak customer-traffic hours. In an embodiment, the printer is in a controlled environment: the customer does not perform service on the printer.

The schedule can be received from an operator who inputs the schedule through a user interface, e.g., a keyboard, touchscreen, terminal, voice-recognition interface, gaze-tracking interface, mouse, trackball, keypad, handwriting-recognition interface (e.g., ANOTO coded paper and electronic pens, or PALM software for recognizing writing on touchscreens), telephone interface with touch-tone- or pulse-dialing recognition, or other interface known in the art. The schedule can also be received electronically through a network connection, a floppy disk, a Flash drive, a CD-ROM, a DVD-ROM/RAM/RW/+RW, IrDA, Bluetooth, or other digital communications techniques known in the art. The schedule can be received from an operator or from another computer, e.g., a master scheduling computer holding the schedules for personnel employed in a store. The schedule can be received from an operator who inputs it into an HTML page served by the printing system or by an auxiliary HTTP server.

Cost-estimating unit 440 receives the schedule, the recorded corresponding data and the recorded corresponding times. Cost-estimating unit 440 selects one of the service times given in the schedule. Cost-estimating unit 440 then estimates costs 445, including a first cost of installing the first RU (holding consumable 490) in receptacle 495 at the selected one of the service times and a second cost of installing the second RU (holding consumable 492) in receptacle 495 at the selected service time. Costs 445 can be expressed in time, money, or a combination, and each cost can include multiple factors. Costs 445 can be negative, indicating a gain rather than a loss. Costs 445 can include net present value (NPV), purchase price of an RU or consumable, lost business due to machine downtime, increased or reduced customer satisfaction, and other hard or soft costs. In an embodiment, costs 445, and particularly the cost of downtime, are calculated using the product mix, since depletion of a consumable not required for all jobs will only result in a loss of revenue for the job types requiring that consumable.

Decision unit 450 responds to costs 445, specifically the first and second costs, and automatically decides which RU should be installed in receptacle 495 at the selected service time. In various embodiments, decision unit 450 selects the lower-cost option if the magnitude of the difference between the costs exceeds a percentage or absolute threshold, and otherwise does not (or does) change the RU in the receptacle; or stores a history of costs 445 and uses the stored history to decide which RU to install in the receptacle.

Interface 460 is responsive to the decision unit for indicating that the selected RU should be installed in the receptacle at the selected service time. The indication can be made to a human operator, to another computer, or to a robot or other automated service unit capable of automatically installing the selected RU in the receptacle. The interface can include any of the interface types listed above from which a schedule can be received, and can also include display terminals (e.g., OLED, PLED, LCD, CRT, cholesteric LC), other visual readouts (e.g. ticker tape), warning lights on the printing system (e.g., red or yellow) to indicate the system needs maintenance, audible alerts such as beeps, bells, buzzes, or bings, automatic sending of messages to pagers, cellular telephones, or other personal electronic devices, tactile feedback such as vibration or raised-pin Braille, or other mechanisms known in the art for providing information from a computer.

One embodiment of a printing system is a photo kiosk used in a retail environment for a store that is not open 24 hours per day. In this environment, service can only be performed at certain times. The service times are before the store opens in the morning, and after the store closes in the evening. If consumables are replenished at these times, customers are not inconvenienced. However, if a consumable is replenished between service times, customers can be inconvenienced, as the kiosk is not available to print pictures. This gives managers of the store incentive to replenish consumables before every shift. However, if an RU is replenished too soon, the consumable (or the full usable amount of consumable in an RU) is not fully used, wasting material costs. This gives managers incentive to wait as long as possible before replenishing a consumable.

Uncertainty in when a consumable will be depleted results from variation in the type and quantity of jobs being printed on the printing system. Monitoring system 430 records, for one or more of the jobs, the corresponding data and time. Cost-estimating unit 440 uses these to build a model of printer usage over the period between the selected service time and a successive service time (in an embodiment, the immediately-following service time). As used herein, the "running period" of the model is the time interval over which the model is calculated, i.e., the interval between the selected service time and the successive service time. Cost-estimating unit 440 uses the model to evaluate whether a consumable will be depleted in the running period.

In this embodiment, consumables 490, 492 are the same (e.g., black toner), and can each be full or partially-depleted. The consumable selected by decision unit 450 is that which is closest to the expected usage during the running period without being less than that expected usage. This results in as much as possible of the remaining consumable in the RU being used and not discarded and also reduces the chance of downtime because of unexpected consumable depletion.

In various embodiments, different algorithms are used to calculate costs and select a consumable. Cost-estimating unit 440 can receive input about the amount of consumable left in each RU and use that input along with the model to calculate costs 445. Cost-estimating unit 440 can be trained in operation: it can record the usage over the full time a particular RU is installed in the printing system, and use that usage as a baseline to estimate future consumable depletion. This baseline can be refined by successive recorded data. Cost-estimating unit 440 can also be pre-programmed at the factory or during installation at the customer's site with a generic or customer-specific estimate of typical usage. Cost-estimating unit 440 can also be re-programmed by the retailer or customer (or service personnel at the direction of the customer) during times when special promotions are being offered (e.g., coupons, sales, receiving certain items free with the purchase of others). These business factors and usage estimates can be used to calculate the cost of depletion between service times and to estimate the amount of consumable that will be used over the remainder of the running period. Decision unit 450 can select a single RU until that RU is depleted to a level lower than that required for the running period, then switch to the other RU.

In various embodiments, cost-estimating unit 440 can include a neural network, hidden Markov model, genetic program, Bayesian network, or other machine learning algorithm to iteratively improve the accuracy or precision of the model. The model can be pre-programmed or derived at run time from measurements or records of the remaining amount of the consumable in each RU. The model can be continuous or discrete in time, and, if discrete, can have a selected granularity, e.g., by the microsecond, millisecond, second, minute, hour, day, or by three hours, six hours, twelve hours, one week, four weeks, one month, three months, a season of the year (which can be more or less than three months depending on latitude and climate), six months, one year, or another selected time interval.

The model can include one or more time intervals. Over each interval, an average, mode, range, minimum, maximum, fit (e.g., linear, power, exponential, logarithmic, or moving-average) or distribution (e.g. Gaussian or bimodal) can be calculated. For example, the model can represent the corresponding times over a time interval as arrivals characterized by a Poisson distribution, or using the average interval between consecutive corresponding times.

An example of a model useful for calculating which type of paper to load in a printer is discussed below with reference to FIGS. 9A-9F.

A "usage regime" is a plurality of consecutive running periods over which the same model can be used effectively. For example, a usage regime can extend over one season, or from Thanksgiving to Christmas (in the United States of America), or during Golden Week (in April/May in Japan; in October in China). Different models can be used in different usage regimes. Models can be derived only from data in the same usage regime, to reduce variability in the modeled data set.

Still referring to FIG. 4, in another embodiment, a printing system decides whether to replenish a consumable at a service time. Front end 410 provides jobs 415, as described above. Marking engine 420 uses consumable 490 to print selected jobs, and monitoring system 430 records information 435, as described above.

Cost-estimating unit 440 responds to the received personnel schedule 480 (as described above), and the recorded corresponding data and times (information 435). Cost-estimating unit 440 automatically estimates a first cost of replacing the RU holding consumable 490 with a different RU at a selected one of the service times. Cost-estimating unit 440 also estimates a second cost of not replenishing consumable 490 at the selected service time. These costs can be estimated as described above. For example, the cost of discarded material if the consumable is replenished can be estimated, and the cost of downtime if the RU is depleted when customers want to use the printing system can be estimated.

Decision unit 450 automatically decides whether the RU holding consumable 490 should be replaced with a different RU at the selected service time using the first and second costs. This is analogous to the decision of whether to install a first or a second consumable, but the decision is whether to keep the installed RU and its consumable or replace it with a RU having a new consumable (e.g., consumable 492). Decision unit 450 can operate as described above.

Interface 460 is responsive to decision unit 450 for indicating that the RU holding consumable 490 should be replaced at the selected service time. This indication can be made to an operator or another computer, as described above.

Figure 5:
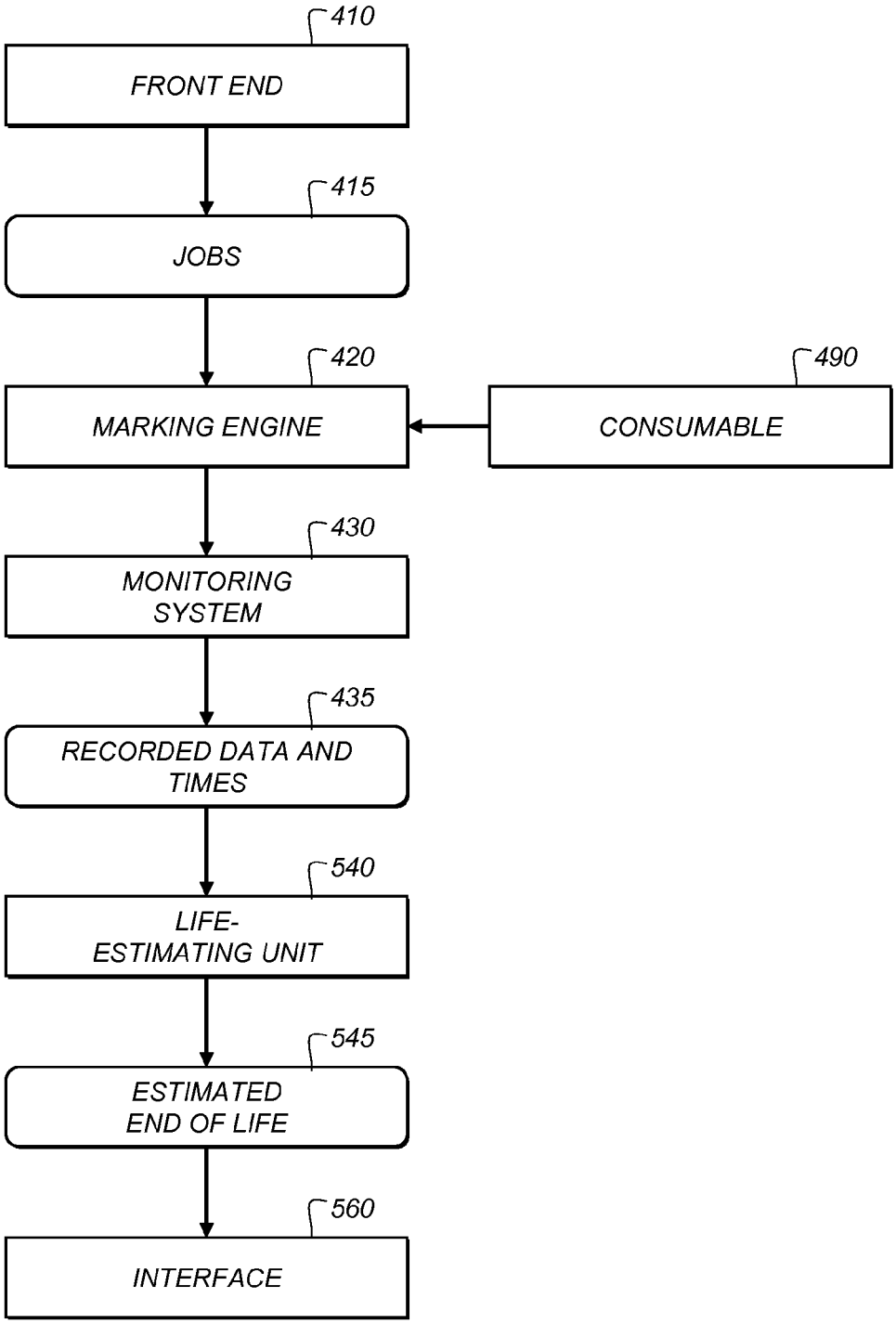
FIG. 5 is a schematic and dataflow diagram of a printing system for indicating when to replenish a consumable according to an embodiment.

FIG. 5 is a schematic and dataflow diagram of a printing system for indicating when to replenish a consumable according to an embodiment. Front end 410, jobs 415, marking engine 420 using consumable 490, monitoring system 430, and information 435 are as described above.

Life-estimating unit 540 responds to information 435 (the recorded corresponding data and recorded corresponding times) and estimates the end of life 545 of consumable 490. In an embodiment, life-estimating unit 540 produces a model of consumable usage over time. Life-estimating unit receives information about the expected life of consumable 490 (e.g., number of pages, amount of toner) and compares it to the model to estimate end of life. For example, if the consumable is the fuser roller and its lifetime is a fixed number of sheets printed, the lifetime will not decrease while the store in which the printer system is located is closed. The model will take into account the closing times and only calculate expected decreases in remaining life for open hours, and those decreases only at the typical rate of page printing during the hour.

Interface 560 receives estimated end of life 545 from life-estimating unit 540 and indicates to an operator, computer, or other entity (as described above) that the RU containing consumable 490 should be replaced. This indication can be made at, or a selected time in advance of, the estimated end of life 545 of consumable 490.

In an embodiment, the interface further indicates the estimated end of life 545 of consumable 490. This permits an operator, maintenance system, or other interested party to plan ahead to replenish the consumable before its end of life, e.g., at a service time.

Figure 6:
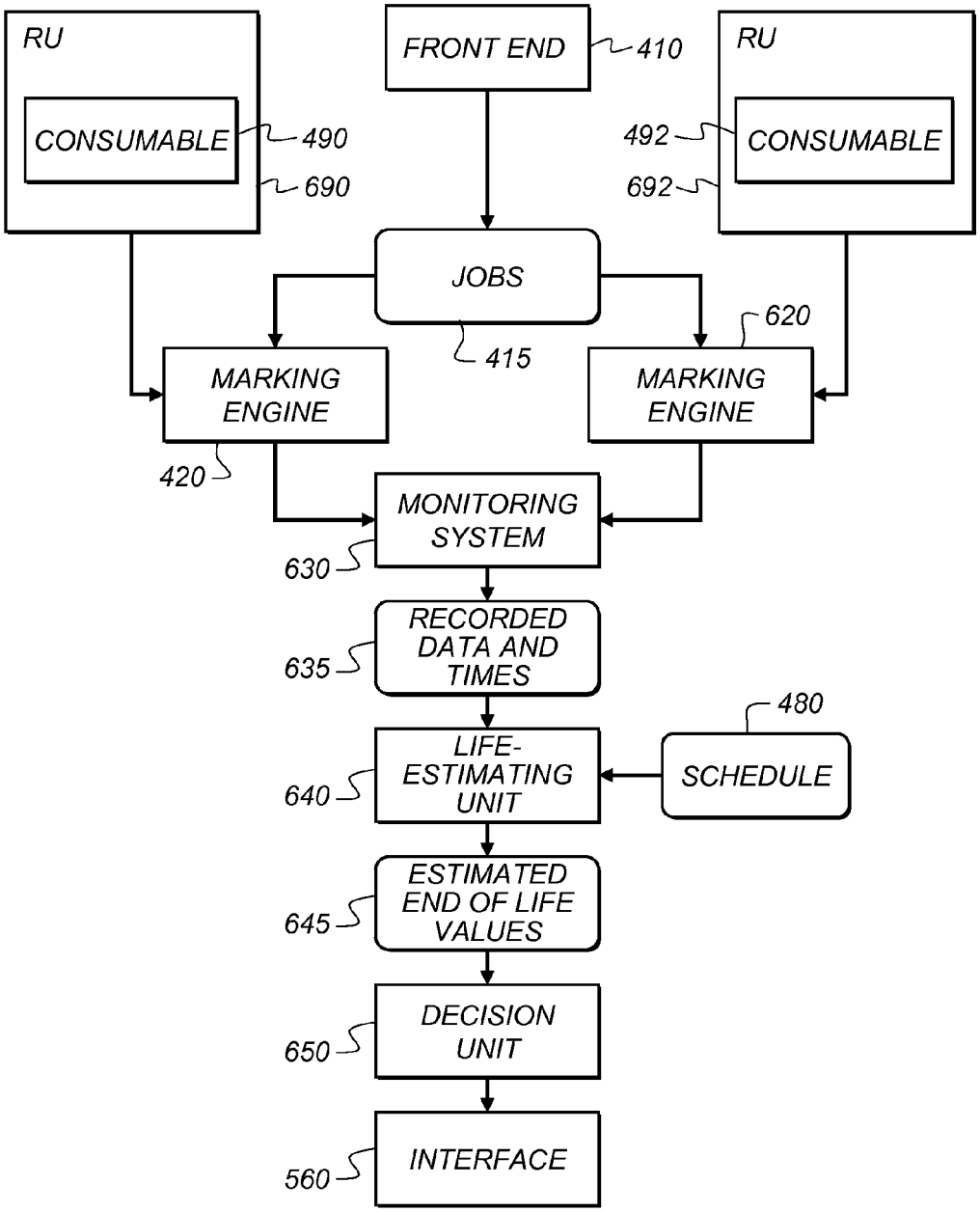
FIG. 6 is a schematic and dataflow diagram of a multi-printer system for effectively using a consumable in two printers according to an embodiment.

FIG. 6 is a schematic and dataflow diagram of a multi-printer system for effectively using a consumable in two printers according to an embodiment. The multi-printer system indicates that a replaceable unit (e.g., RU 690) should be moved from one marking engine 420 to another 620 so that a consumable in the replaceable unit is not discarded. Front end 410 and jobs 415 are as described above. The multi-printer system includes multiple marking engines, either in the same chassis or in respective, different chassis.

First electrophotographic marking engine 420 uses first consumable 490 stored in first RU 690 to print selected jobs at corresponding times on corresponding receivers. Second electrophotographic marking engine 620, uses second consumable 492 stored in second RU 692 to print selected jobs at corresponding times on corresponding receivers. First and second RUs 690, 692 are interchangeable. That is, each can be employed in either marking engine 420, 620. In an embodiment, the two RUs 690, 692 are mechanically interchangeable so that each can connect to the receptacle on either marking engine 420, 620. However, RUs 690, 692 can have different contents: consumables 490 and 492 can be different. In one example, consumable 490 is black toner useful with text documents, and consumable 492 is clear toner useful with photographs.

Monitoring system 630 records the corresponding data and corresponding times for a plurality of the jobs on the first and second marking engines as information 635. Each recorded piece of information 635 is identified with the corresponding marking engine 420, 620.

Life-estimating unit 640 responds to received personnel schedule 480 (described above) and information 635 (the recorded corresponding data and the recorded corresponding times). Life-estimating unit 640 estimates the remaining life of first consumable 490 in first EP marking engine 420 and the remaining life of second consumable 492 in second EP marking engine 620 at a selected one of the service times.

Decision unit 650 responsive to the estimated lives of the first and second consumables 490, 492 for determining that first RU 690 in first EP marking engine 420 should be moved to the second EP marking engine 620 at the selected service times. This decision can be made similarly to the ways described above, analogously to the decision of whether to install first RU 690 or second RU 692 in marking engine 420 or in marking engine 620. In addition, however, decision unit 650 takes into account the modeled usage of both marking engines 420, 620 during the running period.

In an embodiment, decision unit 650 includes a cost-estimating unit (e.g. unit 440, FIG. 1) for estimating the relative costs of moving RU 690 and not moving RU 690. The costs are calculated based on the remaining life of each consumable 490, 492 and on the usage model for marking engines 420, 620.

For example, if consumable 490 is black toner particularly useful for text documents, and consumable 492 is clear toner particularly useful for photo documents, decision unit 650 can decide to move RU 690 from first marking engine 420 to second marking engine 620 if marking engine 620 is expected based on the model to have a high volume of text documents during the running period. This decision can be made even if RU 690 contains enough of consumable 490 to satisfy the needs of marking engine 420 during the running period, as long as the expected cost is lower for moving than not moving.

In an embodiment, decision unit 650 decides that second RU 692 should be moved from second marking engine 620 to first marking engine 420 at the selected service time. That is, RUs 690, 692 are exchanged. In various embodiments, the costs produced by cost-estimating unit 440 are also based on a comparison between the remaining lives of consumables 490, 492. For example, if consumables 490, 492 are expected to reach end of life within a selected time of each other (e.g., one hour, or 15 minutes), the costs can be adjusted so that they are exchanged at a time when the differential expected usage between the two printers will move the expected end of life values 645 farther apart.

In one example of this embodiment, consumables 490, 492 are both black toner. RU 690 does not have enough toner to satisfy marking engine 420 during the running period, but RU 692 does. If RU 690 has enough toner for marking engine 620 during the running period (e.g., because marking engine 620 is expected to print mostly photos during the running period), exchanging the two RUs 690, 692 advantageously provides each marking engine 420, 620 with enough consumable for the running period, without having to discard RU 690, which might be largely depleted.

In an embodiment, the consumables are rolls of print media. Again, the life remaining of the consumable is known, the anticipated replacement time is calculated, and a determination is made whether the consumable is used during the current running period or set aside and used during a more advantageous running period, e.g., a running period in which modeled demand is approximately equal to, but less than, the amount of the consumable remaining.

Interface 560 responds to decision unit 650 and indicates, as described above, that first RU 690 should be moved from first EP engine 420 to second EP engine 620 at the selected service time, so that a remaining amount of consumable 490 in first RU 690 is not discarded. This advantageously reduces material costs without increasing downtime costs. In an embodiment, the interface further indicates that second RU 692 should be moved from second EP engine 620 to first EP engine 420 at the selected service time.

Figure 7:
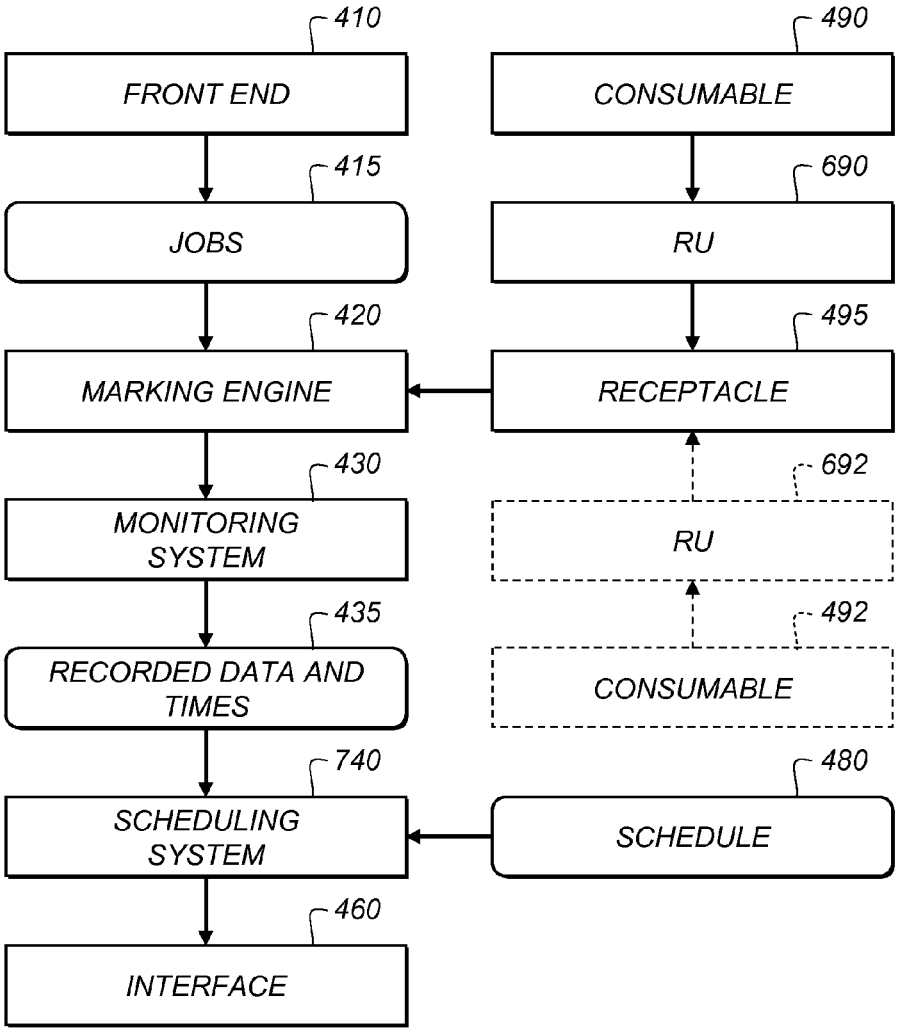
FIG. 7 is a schematic and dataflow diagram of a printing system for indicating a replaceable unit should be removed from a marking engine.

FIG. 7 is a schematic and dataflow diagram of a printing system for indicating a replaceable unit should be removed from a marking engine so that the consumable in the replaceable unit is not discarded. Front end 410, jobs 415, receptacle 495, marking engine 420, monitoring system 430, information 435 (recorded data and times), and interface 460 are as shown in FIG. 4. Interchangeable replacement unit (RU 690) having first consumable 490, and RU 692 having consumable 492, are as shown in FIG. 6.

Scheduling system 740 is responsive to received personnel schedule 480 (discussed above), the recorded corresponding data, and the recorded corresponding times. Scheduling system 740 selects a first one of the service times at which first RU 690 should be removed from receptacle 495, and a second one of the service times at which first RU 690 should be reinstalled in receptacle 495.

Interface 460 is responsive to scheduling unit 740 for indicating, as described above, that first RU 690 should be removed from receptacle 495 at the first service time and reinstalled in receptacle 495 at the second service time, so that consumable 490 in first RU 690 is not discarded.

In an embodiment, a second RU is installed in receptacle 495 between the first and second service times. That is, a fresh RU is loaded in the printer while first RU 690 is in storage out of receptacle 495.

In an embodiment, second RU 692 is interchangeable with first RU 690 and holds second consumable 492 which is the same as or different from first consumable 490. Interface 460 indicates that second RU 692 should be installed in receptacle 495 at the first service time and removed from receptacle 495 at the second service time.

In various embodiments, e.g. with toner or rolls of print media, the remaining life of the consumable can be determined and stored by the printer. The remaining life can be stored in a memory in the printer, or stored in a writeable memory chip on the RU (e.g. an EPROM, EEPROM, NVRAM, or Flash memory, or chip with fusible links for one-time writing). The RU can then be stored rather than discarded, and can be reinstalled in the printer (e.g., by the operator or by a robot) when an appropriate running period is identified. In various embodiments, the remaining life of the consumable can be determined by accumulating the amount of the consumable used, and storing the value accumulated in a memory in the RU. Other inputs can be used in combination with the accumulated value to determine remaining life. For example, for toner, a toner sensor (e.g., an inductive toner-concentration sensor or piezoelectric powder-level sensor) can be used with an accumulated amount of toner removed from the RU to determine the remaining life (amount of toner in the RU), and to determine when to remove toner from the RU for use by the printer.

In various embodiments, the writeable memory on the RU also includes a unique identification code to identify an RU. This permits verifying that the correct RU has been inserted in the correct receptacle in systems where a central controller schedules RU changes for a plurality of marking engines and a plurality of RUs. The RU memory can also contain information related to the manufacturing of the RU or the consumable therein, such as date and place of origin. This facilitates root-cause failure analysis by permitting defects to be traced back to their source in manufacturing. The RU memory can also contain information permitting the printer to improve its utilization of the consumable in the RU. For example, an RU of toner can contain information about which color of toner is in the RU or about the size of toner particles in the toner. The printer can use this information to select image-processing, development, and fusing conditions appropriate to the specific toner in the RU.

Figure 8A:
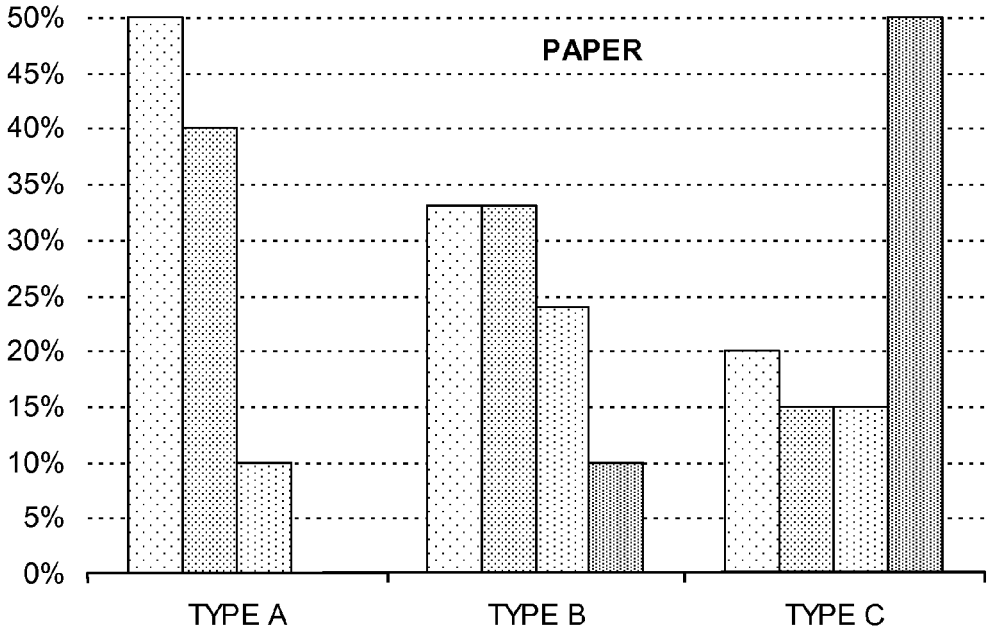
FIGS. 8A and 8B are representative graphs of product mix in various printing systems.
Figure 8B:
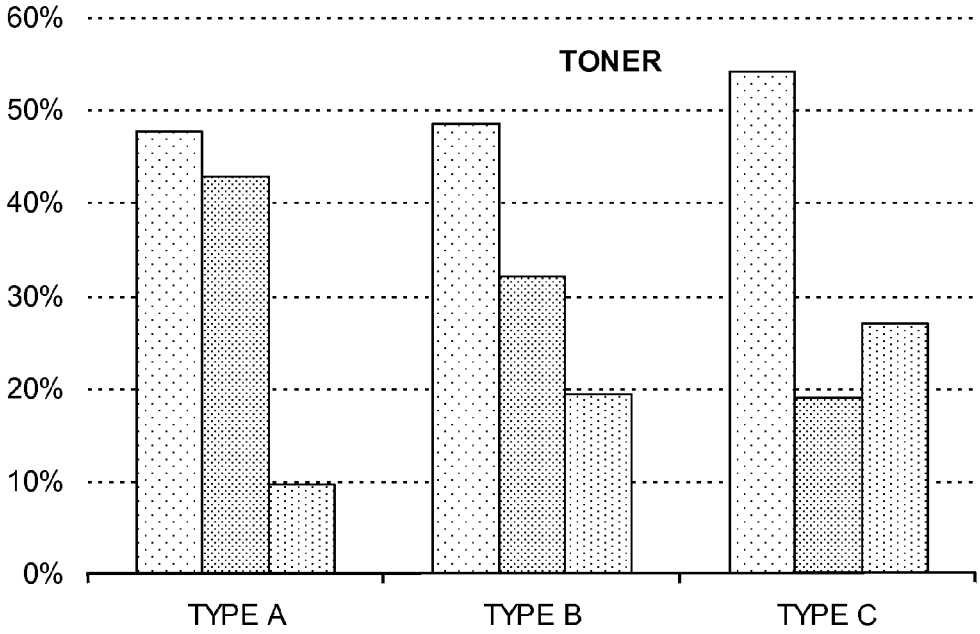

FIGS. 8A and 8B are representative graphs of product mix in various types of printing systems. A "product mix" is the percentage of a type of consumable (here, paper in FIG. 8A and toner in FIG. 8B) that a type of printer uses in printing its typical job stream. Both charts show product mix for three different types of representative simulated printing systems. For example, FIG. 8A shows that printers of type A do not use any of the fourth (right-most) paper type, but 50% of the paper used on a printer of type C is of the fourth paper type. Similarly, FIG. 8B shows that a type C printer has a much higher usage of the third toner type than a type A printer. In various embodiments, a model is made for each printer type, or for each individual printer. Examples of types of printers include business laser printers, which typically produce black-and-white, duplex, 8.5"×11" or A4 documents with borders, and photo printers, which typically produce full-color, simplex, 4"×6" borderless documents.

The product mix of a particular type of printer can vary over time. For example, FIGS. 9 and 10, discussed below, show examples of the effects of variation in product mix from weekdays (Friday) to weekends (Saturday). Product mix can also vary by season. For example, a photo printer can have a higher percentage of 4"×6" prints in the summer (Northern Hemisphere) and a higher percentage of greeting cards (e.g., 5"×7" cards, folded in half) before Christmas. Other examples of products experiencing seasonal demand, which demand results in seasonal shifts in product mix, include holiday photo cards (4"×8") and calendars in December and graduation and wedding photo albums during the summer in the Northern Hemisphere. In the Southern Hemisphere, demand for both vacation prints (4"×6") and greeting cards can be high in December. Additionally, over a single day, even if the product mix remains steady, the volume of prints per hour can change. For example, usage can be highest during the lunch hour and after dinner. Long-term (e.g., seasonal) and short-term (e.g., hourly) shifts can both be modeled and used to determine what action should be taken at a service time, or when a service time should take place.

FIGS. 9A-9F show a representative simulated model according to an embodiment. This example shows the operation of a model particularly useful with embodiments of the systems shown in FIGS. 4 and 5, discussed above. However, the modeling techniques described with reference to this figure can be used with other embodiments.

In this example, the printer has receptacles holding two paper types as consumables: bond and photo. Bond paper is typically used for printing office documents such as memos and reports. Photo paper is typically used for printing photographs, calendars, and other specialty photo products. In addition to one receptacle dedicated to bond paper and another dedicated to photo paper, the printer has a third receptacle 495 (FIG. 4) which can be loaded with either type of paper.

Figure 9A:
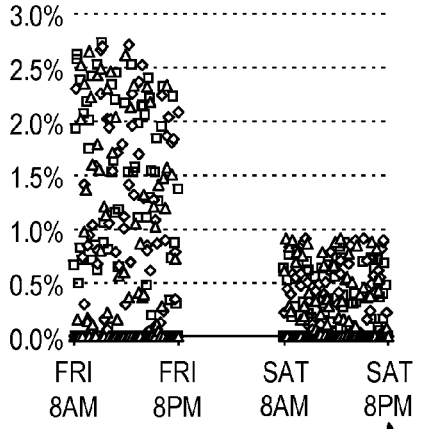
FIGS. 9A-9F show a representative model according to an embodiment.
Figure 9D:
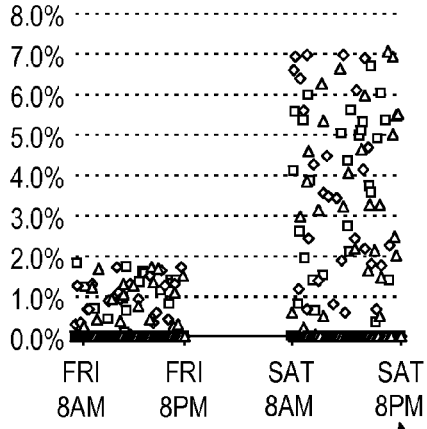
Figure 9B:
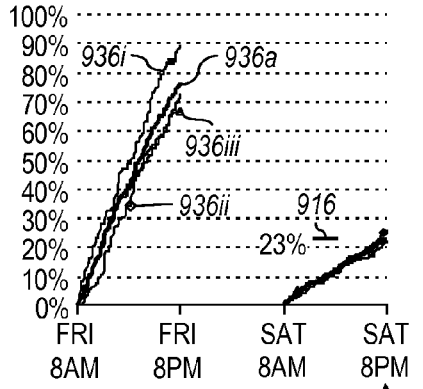
Figure 9E:
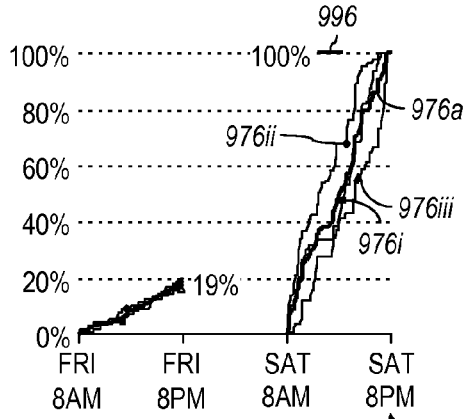
Figure 9C:
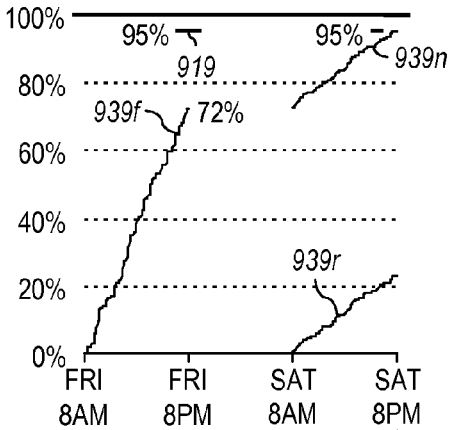
Figure 9F:
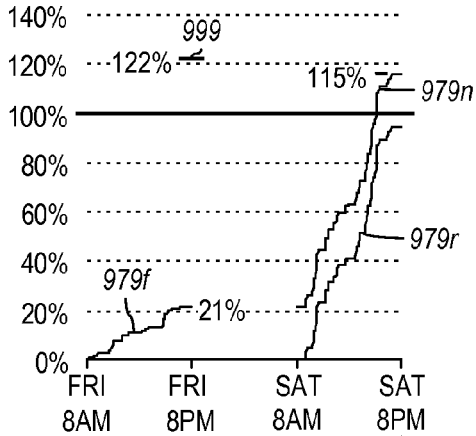
Figure 10A:
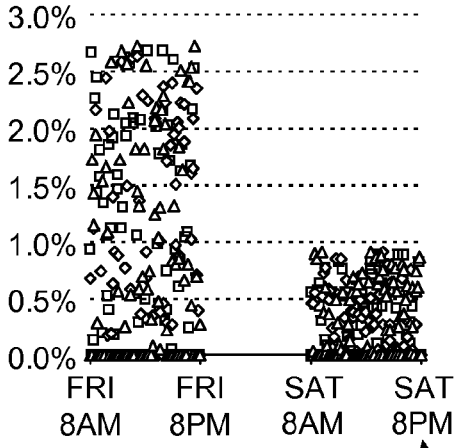
FIGS. 10A-10F show another representative model according to an embodiment.
Figure 10D:
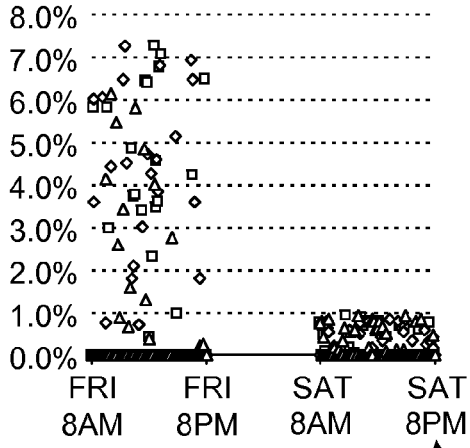
Figure 10B:
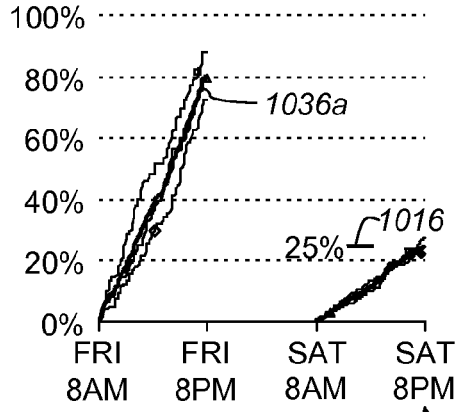
Figure 10E:
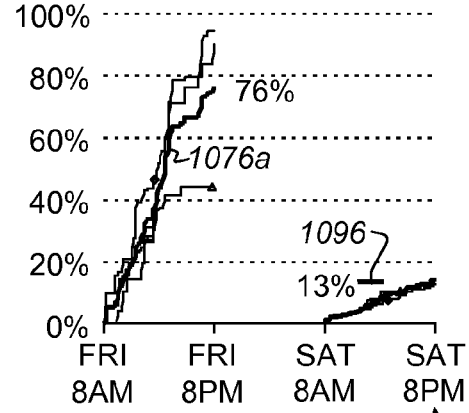
Figure 10C:
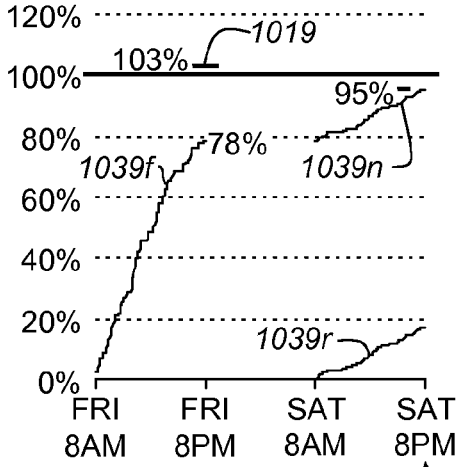
Figure 10F:
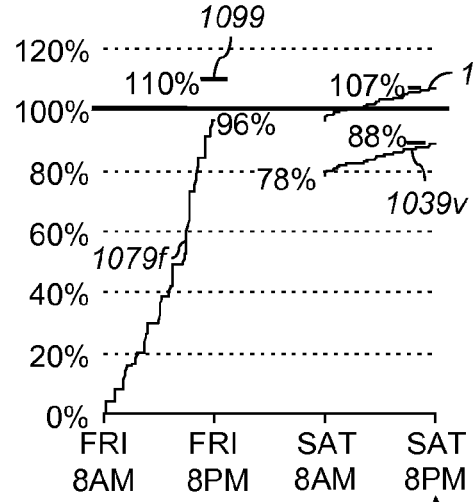

The six charts in FIGS. 9A-9F correspond to bond paper, in the left-hand column (FIGS. 9A-9C), and photo paper, in the right-hand column (FIGS. 9D-9F). The top two charts (FIGS. 9A, 9D) are instantaneous usage, the middle two charts (FIGS. 9B, 9E) are cumulative usage over a running period, and the bottom two charts (FIGS. 9C, 9F) show how the modeled usage can be used to determine which consumable to select. The abscissa of each chart is time of day; two running periods are shown on each chart (Friday 8:00 AM-8:00 PM and Saturday 8:00 AM-8:00 PM). The service times are the beginning and ends of open hours, here, Friday at 8:00 AM, Friday at 8:00 PM, Saturday at 8:00 AM, and Saturday at 8:00 PM.

The ordinate of each chart is the percentage of the available consumable in an RU used. When 100% is used, the RU is depleted and should be replaced. Print jobs are modeled as being provided at a steady rate, but with varying sizes, so that each job consumes a variable amount (uniformly distributed within determined limits) of each consumable. In this simulation, data are recorded for three weeks prior to using the model to determine which consumable to install. All lines plotted on these charts are smoothed for clarity, since consumption of a consumable is modeled as an instantaneous (step-function) process. All percentages shown are rounded to the nearest whole percentage, so values shown may not add exactly.

Charts 923 (FIG. 9A) and 983 (FIG. 9D) show paper consumption for each of three weeks (squares, diamonds, triangles, respectively) over which data are simulated. As shown, consumption of bond paper is much higher on Friday (a business day) than Saturday (a weekend). Consumption of photo paper, however, is much higher on Saturday (when families can spend time together with their photos) than on Friday (when family members are apart).

Charts 926 (FIG. 9B) and 986 (FIG. 9E) show cumulative paper consumption for each of the three weeks, and the average of those three. Each curve on these charts has two segments, one for each running period. For clarity, the curves are only labeled in one running period. Curves 936*i*, 936*ii*, 936*iii* are the sums of the consumption shown in chart 923 for weeks 1, 2, and 3, respectively. Curves 976*i*, 976*ii*, 976*iii* are the sums of the consumption shown in chart 983 for weeks 1, 2, and 3, respectively.

Curves 936*a* and 976*a* are the averages of the three curves for the corresponding paper type. These show the modeled total usage of the corresponding consumable over the corresponding running period. Markers 916, 996 show and are labeled with the total usage over the corresponding running period. Curve 976*a* is also labeled with the average total usage on Friday, as will be discussed below.

Charts 929 (FIG. 9C), 989 (FIG. 9F) show data simulated for week 4. Curves 939*f*, 979*f* show the data for Friday. Curves 939*f*, 979*f* are labeled with the total usage on Friday.

Markers 919, 999 show and are labeled with the expected usage by the end of Saturday if the RU is not replaced between the Friday and Saturday running periods. Marker 919 is the Friday usage from the top of curve 939*f* plus the modeled Saturday usage shown in chart 926 at marker 916. Marker 999 is the Friday usage from the top of curve 979*f* plus the modeled Saturday usage shown in chart 986 at marker 996.

Curves 939*n* and 979*n* show the actual usage of toner on Saturday if the RU is not replaced before the Saturday running period. Curves 939*r* and 979*r* show the usage of toner on Saturday if the RU is replaced. Curves 939*n*, 979*n* are labeled with the total usage (assuming no replacement) for Friday and Saturday together. The 100% line (depletion point) is shown for ready visualization of when an RU is depleted. Curve 979*n* shows an example of a deviation between modeled and actual usage (122% modeled vs. 115% actual); such deviations are normal in modeling applications.

As shown by curve 939*n*, the expected usage of bond paper on Saturday does not deplete the RU, even if the same RU is used on Friday and Saturday (95%<100%). However, as shown by curve 979*n*, the expected usage of photo paper on Saturday would deplete the RU if the Friday RU was also used on Saturday (122%>100%). Therefore, the cost of installing the bond-paper RU in the third receptacle 495 on Friday at 8:00 PM (or Saturday at 8:00 AM) is higher than the cost of installing the photo-paper RU in third receptacle 495. Installing the bond paper is expected to result in depletion between service times and a corresponding loss of revenue and customer satisfaction. Therefore, decision unit 450 (FIG. 4) will decide to install the photo-paper RU in third receptacle 495 on Fri. at 8 PM or Sat. at 8 AM.

This model is also useful in embodiments for deciding whether to replenish a consumable at a service time. In a printer with two receptacles, one for bond paper and one for photo paper, the bond paper RU does not need to be replaced Friday at 8:00 PM (95%<100%), but the photo-paper RU does need to be replaced (122%>100%).

This model is also useful for embodiments of the system shown in FIG. 7. For example, Friday at 8:00 PM, 21% of the photo-paper RU has been used, so 79% remains. The photo-paper RU can be removed from the printer and stored until the following Friday. Each Friday, 19% of the RU is expected to be used, as shown by the label on chart 986, curve 976*a*, Friday at 8:00 PM. Therefore the photo-paper RU should be usable for five Fridays, totaling usage of 95% of the photo paper in the RU, before it has to be discarded. If another day needs only 5% of an RU of photo paper, or if the cost of discarding the 5% is higher than the cost of downtime in case of depletion during business hours, the remaining 5% can also be used, as discussed above.

FIGS. 10A-10F show another representative model according to an embodiment. This example shows the operation of a model particularly useful with embodiments of the system shown in FIG. 6, discussed above. However, the modeling techniques described with reference to this figure can be used with other embodiments.

The layout and axes of the six charts in FIGS. 10A-10F are as in FIGS. 9A-9F (discussed above), respectively. However, the two columns are different types of printing systems (different product mixes in FIGS. 8A, 8B) rather than different consumables; the same consumable is used in both of these examples. The left-hand column (FIGS. 10A-10C) corresponds to RU 690 (FIG. 6) in marking engine 420 (FIG. 6) and the right-hand column (FIGS. 10D-10F) corresponds to RU 692 (FIG. 6) in marking engine 620 (FIG. 6).

Charts 1023 (FIG. 10A) and 1083 (FIG. 10D) show the simulated instantaneous usage of the consumable in the two marking engines on Friday and Saturday of three simulated weeks (analogous to charts 923 and 983 shown in FIGS. 9A, 9D, above).

Charts 1026 (FIG. 10B) and 1086 (FIG. 10E) show the simulated cumulative usage over the three weeks (analogous to charts 926 and 986 shown in FIGS. 9B, 9E, above). Curves 1036*a* and 1076*a* show the average of the three weeks, which is used as the model. Markers 1016, 1096 show and are labeled with the total usage over the corresponding running period. Curve 1076*a* is also labeled with the average total usage on Friday, as will be discussed below.

Charts 1029 (FIG. 10C) and 1089 (FIG. 10F) show the usage on Friday and Saturday of a fourth week (analogous to charts 929 and 989 shown in FIGS. 9D, 9F, above). Charts 1029 and 1089 show the cumulative usage of whichever RU is installed in marking engines 420 and 620, respectively. Curves 1039*f* and 1079*f* show the actual usage on Friday (analogous to curves 939*f* and 979*f* shown in FIGS. 9C, 9F). Markers 1019, 1099 (analogous to markers 919, 999 shown in FIGS. 9C, 9F) show and are labeled with the expected usage by the end of Saturday if the RU is not replaced or exchanged between the Friday and Saturday running periods. Marker 1019 is the Friday usage from the top of curve 1039*f* plus the modeled usage shown in chart 1026 at marker 1016. Marker 1099 is the Friday usage from the top of curve 1079*f* plus the modeled usage shown in chart 1086 at marker 1096.

Curves 1039*n* and 1079*n* show the usage if an RU is not moved or exchanged between Friday and Saturday (analogous to curves 939*n* and 979*n* shown in FIGS. 9C, 9F). Curve 1039*v* on chart 1089 shows the usage if RU 690 is moved between marking engines 420 and 620. Curve 1039*r* on chart 1029 shows the usage if RU 690 is replaced with a new RU.

As shown in chart 1029, at the end of Friday, 78% of consumable 490 (FIG. 6) in RU 690 has been used, so 22% remains. 96% of consumable 492 (FIG. 6) in RU 692 has been used, so 4% remains. However, the modeled usage of the consumables in both marking engines (103% at marker 1019, 110% at marker 1099) exceeds 100% for both marking engines 420, 620 on Saturday. The modeled usage of RU 692 on Saturday in marking engine 620 is 14%=110%−96%.

Since the 14% required on Saturday in marking engine 620 is less than the 22% available in RU 690, decision unit 650 (FIG. 6) decides that RU 690 should be moved to marking engine 620 at the selected service time (either Friday at 8:00 PM or Saturday at 8:00 AM). A new RU can then be installed in marking engine 420 to replace RU 690. With RU 690 moved, as shown by curve 1039*v* in chart 1089, cumulative usage on Saturday for RU 690 in marking engine 620 is 88%. Therefore more of the 22% of RU 690 remaining after Friday is used, and less is discarded.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
102, 103 roller
104 transmission densitometer
105 power supply
109 interframe area
110 light beam
111, 121, 131, 141, 151 imaging member
112, 122, 132, 142, 152 transfer member
113, 123, 133, 143, 153 transfer backup member
124, 125 corona tack-down chargers
201 transfer nip
202 second transfer nip
206 photoreceptor
210 charging subsystem
211 meter
212 meter
213 grid
216 surface
220 exposure subsystem
225 development subsystem
226 toning shell
227 magnetic core
240 power source
410 front end
415 jobs
420 marking engine
430 monitoring system
435 information
440 cost-estimating unit
445 costs
450 decision unit
460 interface
480 schedule
490 consumable
492 consumable
495 receptacle
540 life-estimating unit
545 estimated end of life/data
560 interface
620 marking engine
630 monitoring system
635 information
640 life-estimating unit
645 end of life values
650 decision unit
690 RU
692 RU
740 scheduling system
916, 919 marker
923, 926, 929 chart
936*a*, 936*i*, 936*ii*, 936*iii* curve
939*f*, 939*n*, 939*r* curve
976*a*, 976*i*, 976*ii*, 976*iii* curve
979*f*, 979*n*, 979*r* curve
983, 986, 989 chart

996, 999 marker
1016, 1019 marker
1023, 1026, 1029 chart
1036*a* curve
1039*f*, 1039*n*, 1039*r*, 1039*v* curve
1076*a* curve
1079*f*, 1079*n* curve
1083, 1086, 1089 chart
1096, 1099 marker
1100 inkjet printhead
1110 inkjet printhead die
1111 substrate
1112 image data source
1114 controller
1115 image processing unit
1116 electrical pulse source
1118 first fluid source
1119 second fluid source
1120 first nozzle array
1121 nozzle(s)
1122 ink delivery pathway (for first nozzle array)
1130 second nozzle array
1131 nozzle(s)
1132 ink delivery pathway (for second nozzle array)
1181 droplet(s) (ejected from first nozzle array)
1182 droplet(s) (ejected from second nozzle array)
1200 carriage
1250 printhead
1251 printhead die
1253 nozzle array
1254 nozzle array direction
1256 encapsulant
1257 flex circuit
1258 connector board
1262 multi-chamber ink tank
1264 single-chamber ink tank
1300 printer chassis
1302 paper load entry direction
1303 print region
1304 media advance direction
1305 carriage scan direction
1306 right side of printer chassis
1307 left side of printer chassis
1308 front of printer chassis
1309 rear of printer chassis
1310 hole (for paper advance motor drive gear)
1311 feed roller gear
1312 feed roller
1312*a* feed roller shaft
1313 forward rotation direction (of feed roller)
1320 pick-up roller
1322 turn roller
1323 idler roller
1324 discharge roller
1325 star wheel(s)
1330 maintenance station
1370 stack of paper or receiver
1371 top piece or sheet
1380 carriage motor
1382 carriage guide rail
1383 encoder fence
1384 belt
1390 printer electronics board
1392 cable connectors
d spacing
ITM1-ITM5 intermediate transfer member
PC1-PC5 imaging member
$R_n$-$R_{(n-6)}$ receiver
S slow-scan direction
TR1-TR5 transfer backup member

The invention claimed is:

1. A multi-printer system for indicating a replaceable unit should be moved from one marking engine to another so that a consumable in the replaceable unit is not discarded, comprising:

a. a front end for providing a plurality of print jobs to be printed, each having corresponding data;

b. a first marking engine, for using a first consumable stored in a first replaceable unit (RU) to print selected jobs at corresponding times on corresponding receivers;

c. a second marking engine, for using a second consumable stored in a second replaceable unit (RU) to print selected jobs at corresponding times on corresponding receivers, wherein the first and second replaceable units are interchangeable;

c. means for receiving a personnel schedule including a plurality of service times and personnel labor rates;

d. a monitoring system for recording the corresponding data and corresponding times for a plurality of the jobs on the first and second marking engines;

e. a life-estimating unit responsive to the received personnel schedule, the recorded corresponding data, and the recorded corresponding times, for estimating the remaining life of the first consumable in the first marking engine and remaining life of the second consumable in the second marking engine at a selected one of the service times;

f. a decision unit responsive to the estimated lives of the first and second consumables for determining that the first RU in the first marking engine should be moved to the second marking engine at the selected service times; and g. an interface responsive to the decision unit for indicating that the first RU should be moved from the first engine to the second engine at the selected service time, so that a remaining amount of the consumable in the first RU is not discarded.

2. The system according to claim 1, wherein the interface further indicates that the second RU should be moved from the second engine to the first engine at the selected service time.

3. The system according to claim 1, wherein the first and second marking engines are electrophotographic marking engines.

* * * * *